US009004346B2

(12) United States Patent
Farentinos et al.

(10) Patent No.: US 9,004,346 B2
(45) Date of Patent: Apr. 14, 2015

(54) DELIVERY RECEPTACLE

(71) Applicant: Architectural Mailboxes, LLC, Redondo Beach, CA (US)

(72) Inventors: Christopher Andrew Farentinos, Redondo Beach, CA (US); Vanessa Felicia Troyer-Farentinos, Redondo Beach, CA (US); Craig Ronald Steele, Hawthorne, CA (US); Raffy Michael Arce Paje, Redondo Beach, CA (US)

(73) Assignee: Architectural Mailboxes, LLC, Redondo Beach, CA (US)

( * ) Notice: Subject to any disclaimer, the term of this patent is extended or adjusted under 35 U.S.C. 154(b) by 0 days.

(21) Appl. No.: 14/511,063

(22) Filed: Oct. 9, 2014

(65) Prior Publication Data

US 2015/0021386 A1 Jan. 22, 2015

Related U.S. Application Data

(63) Continuation of application No. PCT/US2013/036651, filed on Apr. 15, 2013.

(60) Provisional application No. 61/624,575, filed on Apr. 16, 2012.

(51) Int. Cl.
*A47G 29/22* (2006.01)
*A47G 29/30* (2006.01)

(52) U.S. Cl.
CPC ..... *A47G 29/22* (2013.01); *A47G 29/30* (2013.01)

(58) Field of Classification Search
CPC ..... A47G 29/1209; A47G 29/1214; A47G 29/122; A47G 29/1245; A47G 29/14; A47G 29/16; A47G 29/22; A47G 29/30; A47G 2029/12; A47G 2029/122; A47G 2029/1226; A47G 2029/14; A47G 2029/148; E05G 7/007; E05G 1/026
USPC ..... 232/17, 44, 45, 47–52, 43.3; 340/569; 109/66–68
See application file for complete search history.

(56) References Cited

U.S. PATENT DOCUMENTS 1,576,125 A 3/1926 Yeo
2,548,338 A 4/1951 Behrens
(Continued)

FOREIGN PATENT DOCUMENTS

EP 0919167 A1 6/1999
JP 08-056812 A 3/1996
JP 2010-142406 A 7/2010

OTHER PUBLICATIONS

PCT International Search Report for PCT/US2013/036651, Applicant: Architectural Mailboxes, LLC, Form PCT/ISA/210 and 220, dated Jul. 9, 2013 (7pages).
(Continued)

*Primary Examiner* — William Miller
(74) *Attorney, Agent, or Firm* — Vista IP Law Group LLP

(57) ABSTRACT

A delivery receptacle for receiving objects, such as parcels, has a housing having an input opening, a delivery door rotatably coupled to the housing for opening and closing the input opening, and a drum rotatably coupled to the housing and having a drum access opening accessible through the input opening. The delivery door is mechanically coupled to the drum such that rotation of the delivery door in a first rotational direction causes rotation of the drum in the opposite rotational direction. The delivery door is rotatable between an open position in which the drum is oriented with the drum access opening aligned with the input opening such that a parcel can be inserted into the drum, and a closed position in which the drum is oriented with the drum access opening aligned with a drop area such that a parcel will exit the drum and enter the drop area.

24 Claims, 22 Drawing Sheets

(56) References Cited

U.S. PATENT DOCUMENTS

| | | | | |
|---|---|---|---|---|
| 2,563,150 | A | 8/1951 | Behrens | |
| 3,519,198 | A * | 7/1970 | Benoliel | 232/17 |
| 3,784,090 | A * | 1/1974 | Markham | 232/44 |
| 4,753,387 | A | 6/1988 | Fee et al. | |
| 4,754,126 | A | 6/1988 | Caldwell | |
| 5,818,336 | A * | 10/1998 | Varga et al. | 340/545.1 |
| 5,979,751 | A * | 11/1999 | Maddox | 232/52 |
| 6,244,505 | B1 | 6/2001 | Grimes et al. | |
| 6,347,737 | B1 * | 2/2002 | Madruga | 232/47 |
| 7,158,941 | B1 | 1/2007 | Thompson | |
| 7,246,738 | B2 | 7/2007 | Jonas | |
| 7,249,705 | B2 | 7/2007 | Dudley | |
| 7,337,944 | B2 | 3/2008 | Devar | |
| 7,854,374 | B2 | 12/2010 | Dudley | |
| 8,573,473 | B1 * | 11/2013 | Farentinos et al. | 232/51 |
| 2006/0169762 | A1 * | 8/2006 | Irwin et al. | 232/45 |
| 2008/0067227 | A1 * | 3/2008 | Poss et al. | 232/17 |
| 2008/0121682 | A1 | 5/2008 | Grim et al. | |

OTHER PUBLICATIONS

PCT Written Opinion of the International Search Authority for PCT/US2013/036651, Applicant: Architectural Mailboxes, LLC, Form PCT/ISA/237, dated Jul. 9, 2013 (7pages).

* cited by examiner

DELIVERY RECEPTACLE

CROSS-REFERENCE TO RELATED APPLICATIONS

This application is a continuation of PCT/US2013/036651, filed Apr. 15, 2013, which claims the benefit of U.S. provisional Application No. 61/624,575, filed on Apr. 16, 2012. Priority to the aforementioned application is hereby expressly claimed in accordance with 35 U.S.C. §§119, 120, 365 and 371 and any other applicable laws. The contents of the aforementioned application(s) are hereby incorporated herein by reference in their entirety as if set forth fully herein.

BACKGROUND

The field of the invention generally relates to receptacles for receiving objects while preventing unauthorized access to the received objects, and more specifically to delivery receptacles for receiving parcels and packages such as from delivery services, such as the United States Postal Service (USPS), Federal Express, United Parcel Service (UPS), or other private carriers and delivery services, and the like.

A variety of delivery receptacles have been previously provided, including some having devices for restricting access to parcels deposited into the receptacle to prevent theft or vandalism. For example, U.S. Pat. No. 2,563,150, issued to H. C. Behrens, discloses a an anti-theft rotary drum night depository receptacle. The receptacle has a rotatable cylindrical drum for receiving parcels. The drum is rotated by pulling a knob outwardly, which actuates a rack and pinion operatively connected to the drum. As another example. U.S. Pat. No. 3,784,090, issued to Markham, discloses a safe deposit apparatus having a rotary drum. The drum is actuated by opening a door which is operatively coupled to the drum by mating gears.

Several other representative examples of parcel receptacles with access restricting devices are shown in U.S. Pat. No. 7,246,738 to Jonas; U.S. Pat. No. 7,158,941 to Thompson; and U.S. Pat. No. 6,244,505 to Grimes, which provide further background for the present invention.

SUMMARY

The present invention is directed to an innovative delivery receptacle for receiving objects (such as parcels and mail) deposited into the receptacle, while also restricting access to the deposited objects after they are deposited into the receptacle and dropped into a drop area such as a storage compartment, storage cart, or other secure storage area. For example, the receptacle may be a stand-alone receptacle having a storage compartment or it may be a structure mounted unit (such as a wall or other supporting structure) to which the receptacle is mounted allowing objects to be placed into the receptacle on one side of the structure and then deposited into a drop area on the other side of the structure.

In one embodiment, the receptacle comprises a main housing, which can be wall-mounted, post-mounted, or floor-mounted (e.g. stand-alone). The main housing has a housing cover having an input opening for receiving an object being deposited into the receptacle. A drum is rotatably coupled to the housing and is disposed within the housing cover. The drum has a drum roof, and a drum floor, and may also have a rear panel and side panels, all forming a drum chamber for receiving an object placed into the drum. The drum further comprises a drum access opening through which an object can be placed into the drum chamber.

The drum is rotatable between a loading position and an unloading position. In the loading the position, the drum access opening is accessible through the input opening of the housing cover. In the unloading position, the drum access opening is aligned with a pathway to a secure drop area disposed below or behind the drum, such as a storage compartment within the housing cover. The storage compartment has an access door covering an access opening in the housing cover. The access door may be secured with a locking device.

A delivery door for opening and closing the input opening is rotatably coupled to the housing. The delivery door is rotatable between an open position and a closed position. In the open position, the delivery door is rotated out of the way of the input opening thereby allowing access through the input opening to the drum access opening, in order to place an object in the drum chamber. In the closed position, the delivery door is rotated to block the input opening. A handle may be provided on the exterior of the delivery door for manually rotating the delivery door between the open position and closed position.

The delivery door and drum are mechanically coupled by a linking mechanism such that rotation of the delivery door causes the drum to rotate. The linking mechanism is configured such that rotation of the delivery door in a first rotational direction between the open position and the closed position causes the drum to rotate in an opposite rotational direction (a second rotational direction) between the loading position and the unloading position. The delivery door, drum and linking mechanism are configured such that when the delivery door is in the open position, the drum is in the loading position, and when the delivery door is in the closed position, the drum is in the unloading position.

In one aspect of the invention, the linking mechanism comprises a first gear fixed to the delivery door and a second gear fixed to the drum. The first gear mates with the second gear such that rotation of the first gear in the first rotational direction causes the second gear to rotate in the opposite rotational direction.

In another aspect of the present invention, the drum roof has a drum roof lip which is adjacent a top of the input opening when the drum is in the loading position and a drum floor lip which is adjacent a bottom of the input opening when the drum is in the loading position. Also, the delivery door has an extension flap extending from a bottom portion of the delivery door, the extension flap extends inwardly into the housing and downwardly below the axis of rotation of the drum delivery door. The relative movement and position of the drum roof lip, drum floor lip, and extension flap work together to restrict access through the input opening, past the drum and into the drop area to secure the contents of the drop area from unwanted access. For instance, as the delivery door is opened, the drum roof lip is close by the inside of the delivery door, and the extension flap rotates further inside the housing cover thereby blocking any direct route through the input opening to the drop area. Instead, the only path is a circuitous route under the drum roof lip, then over the extension flap, and then under the drum floor lip.

In another aspect, the drum floor, drum roof and side panels (if utilized) taper outwardly slightly from the rear of the drum to the access opening. The taper of these walls of the drum prevents a package from becoming stuck within the drum after the delivery door is closed and the drum rotates to the unloading position.

In other optional aspects and additional features may include delivery notice and confirmation devices, water/weather control features, and a variety of accessories and options that can be added to the delivery receptacle for added convenience and functionality. For instance, a delivery detector may be provided in the drop area to detect that a parcel has been delivered. The detector is coupled to an indicator which signals that a parcel has been delivered. Drainage holes and drainage contours may be provided in the bottom of the storage compartment in case rain or other moisture enters the housing. The floor of the storage compartment may be spring loaded or adjustable in height to adjust the capacity of the storage compartment. A device may also be utilized which detects whether the storage compartment is full, and automatically locks the delivery door to prevent any further deliveries when the compartment is full. A biasing device, such as a spring or strut coupling the delivery door and/or drum to the housing, may be utilized to assist in opening and/or closing the delivery door. Other optional features and aspects are described in the detailed description below.

In one embodiment, the delivery receptacle is configured as a mail parcel receptacle and is specifically designed to receive a medium sized rectangular box having approximate dimensions of 10.7 inches by 7.5 inches by 12.2 inches.

The operation and use of the delivery receptacle is fairly straightforward. The receptacle starts with the delivery door in the fully closed position, and the drum in the unloading position. In the unloading position, the drum floor is vertical or at least at a steep angle to horizontal so that an object on the drum floor will slide off the drum floor and into the drop area.

To deposit a parcel into the delivery receptacle, a user pulls the handle on the delivery door to rotate the delivery door in a first rotational direction from the closed position to the open position. As the delivery door rotates toward the open position, the linking mechanism causes the drum to rotate in the opposite rotational direction from the unloading position toward the loading position. As the delivery door is rotated to the fully open position, the delivery door moves out of the way of the input opening so that it does not block the input opening, thereby allowing access to the drum. At the same time, the drum rotates to the loading position such that the access opening is aligned with the input opening so that the parcel may be placed into the drum chamber. In the fully open position of the delivery door and the loading position of the drum, the delivery door and floor of the drum may be about horizontal (within 10° ("degrees") of horizontal). The parcel is then inserted into the drum chamber onto the drum floor.

The user then moves the handle and delivery door in the opposite rotational direction from the first rotational direction from the fully open position toward the closed position. As the delivery door is rotated toward the closed position, the linking mechanism causes drum to rotate in the opposite rotational direction of the delivery door, i.e. from the loading position toward the unloading position. As the delivery door rotates toward the closed position, the delivery door begins to block the input opening. As the delivery door continues to rotate to the fully closed position, the delivery door completely blocks the input opening. At the same time, the drum rotates to the unloading position allowing the package to slide off the drum floor, exit the drum chamber, and fall into the drop area.

If the delivery receptacle has a storage compartment, the parcel may be removed from the receptacle as follows. The locking device is unlocked and the access door of the storage compartment is opened. The parcel may then be removed through a parcel removal opening in the housing.

DETAILED DESCRIPTION

Figure 1:
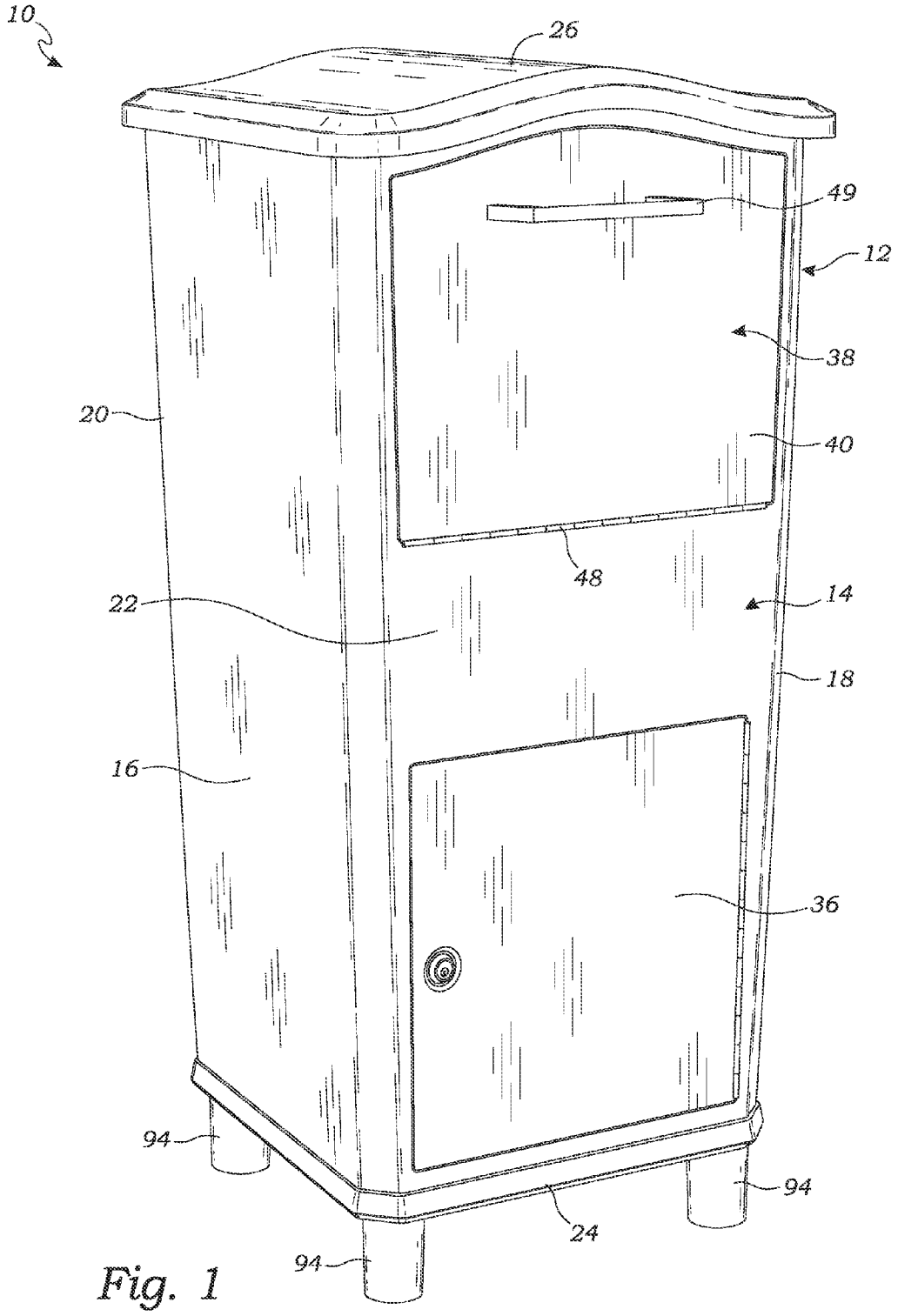
FIG. 1 is a side perspective, view of a delivery receptacle with the delivery door in the fully closed position, according to one embodiment of the present invention.

Turning first to FIGS. 1-9, one embodiment of a delivery receptacle 10 according to the present invention is shown. The receptacle 10 comprises a housing 12 that generally forms the enclosure for the receptacle 10. The housing 12 may have a frame (not shown) and one or more walls that form a housing cover 14. For example, the housing cover 14 of the receptacle 10 may include a first sidewall 16, a second sidewall 18, a back wall 20, a front wall 22, a bottom wall 24, and a top wall or roof 26. The first sidewall 16, second sidewall 18, back wall 20, and front wall 22 may taper slightly from top to bottom of the housing 12 such that the cross-section of the top of the receptacle 10 is slightly larger than the cross-section of the bottom of the receptacle 10. This is possible, at least in part, because the object receiving mechanism at the top of the receptacle needs to be slightly larger than the largest size of object that can be received and stored in the storage compartment at the bottom of the receptacle 10. The housing cover 14 has an input opening 28 in the front side of the receptacle 10. The bottom wall 24 may have one or more drainage holes to drain fluid, such as rain, that enters the housing 12. The bottom wall 24 may have a floor contour that facilitates water flow out through the drain holes. A small basin or collection area may be included, such as in the location of the nut 90, to collect small amounts of water and keep the water away from delivered articles in the storage compartment 30. The bottom wall 24 may also have ribs or striations that raise the pad 80 off the bottom wall 24 to help air flow in damp environments.

Figure 2:
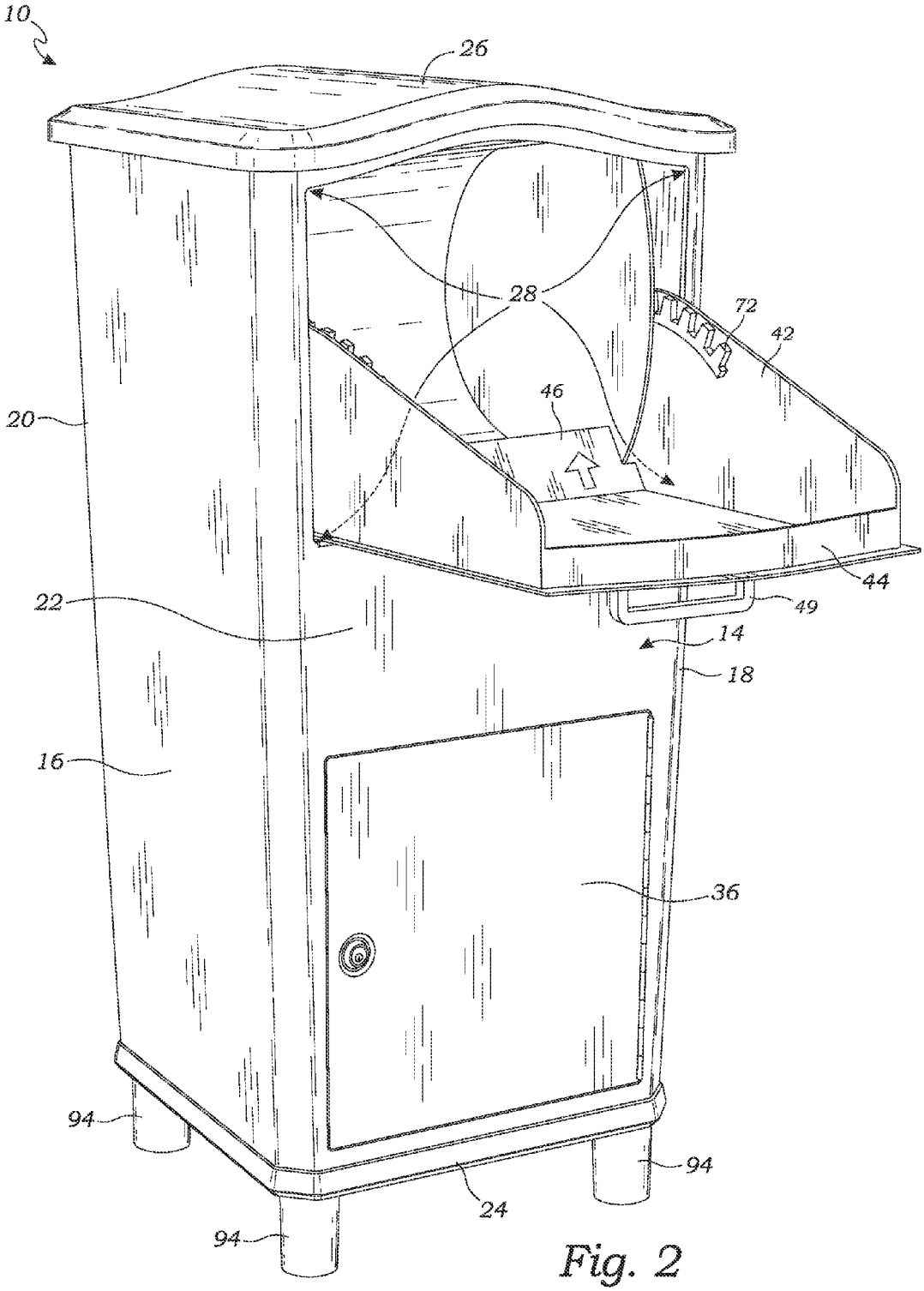
FIG. 2 is a side perspective, view of the delivery receptacle of FIG. 1, with the delivery door in the fully open position.

A delivery door 38 is rotatably coupled to the housing 12 for opening and closing the input opening 28. The delivery door 38 is rotatably coupled to the housing 12 by a hinge 48 connected to the delivery door along the bottom edge of the front panel 40 of the delivery door 38. The hinge 48 may be a continuous/piano hinge extending substantially the width of the delivery door 38, two or more smaller hinges, or other suitable hinge(s). The delivery door 38 is rotatable between a closed position (as shown in FIG. 1) in which the delivery door covers and/or blocks the input opening 28, and an open position (as shown in FIG. 2) in which the delivery door 38 is rotated out of the way of the input opening 28 thereby allowing access through the input opening into the housing 12 to the drum 50. The delivery door 38 comprises a front panel 40, two opposing side panels 42, one on each side of the front panel 40, a top panel 44, and an extension flap 46. The extension flap 46 extends from the bottom portion of the front panel 40 inwardly into the housing 12 and downwardly (when the delivery door is oriented in the substantially vertically in the closed position) below the axis of rotation of the hinge 48. A handle 49 is attached to the exterior side of the front panel 40 for manually rotating the delivery door 38 between the open position and the closed position.

The drum 50 is rotatably coupled to the housing 12 and is disposed within the housing cover 14. The drum 50 comprises a drum floor 52, a drum roof 54, two drum side panels 56 one on each side of, and connecting together, the drum floor 52 and the drum roof 54, and a rear panel 58. The rear panel 58 is has a curved shape having a radius slightly smaller than the shortest distance between the axis of rotation of the drum 50 (i.e. the rotating shaft and bushing assembly 78) and both the back wall 20 and the roof 26, such that the rear panel 58 does not contact the back wall 20 or roof 26 during rotation of the drum 50. The curved shape of the rear panel 58 also helps maximized the volume of the drum chamber 60. The drum floor 52, drum roof 54, drum side panels 56 and rear panel 58 form a drum chamber 60 having a drum access opening 62 for receiving an object being deposited into the receptacle 10. The drum floor 52, drum roof 54, and drum side panels 56 taper outwardly slightly from the rear panel 58 of the toward the drum access opening 62. The taper of these walls of the drum 50 prevents an object from becoming stuck within the drum chamber 60 and facilitates the dropping of an object out of the drum chamber 60 when the drum 50 is rotated to the unloading position. The drum floor 52 may have striations oriented in the direction of the insertion of an object into the drum chamber 60 to decrease friction and facilitate parcels sliding along the drum floor 52 as the drum 50 rotates.

The drum 50 is rotatably coupled to the housing 12 by a pair of brackets 76, one bracket 76 on each side of the drum 50. One side of the bracket 76 is fastened to the housing 12, such as to the roof 26, and the other side of the bracket 76 is coupled to the drum 50 via a rotating shaft and bushing assembly 78.

Figure 3:
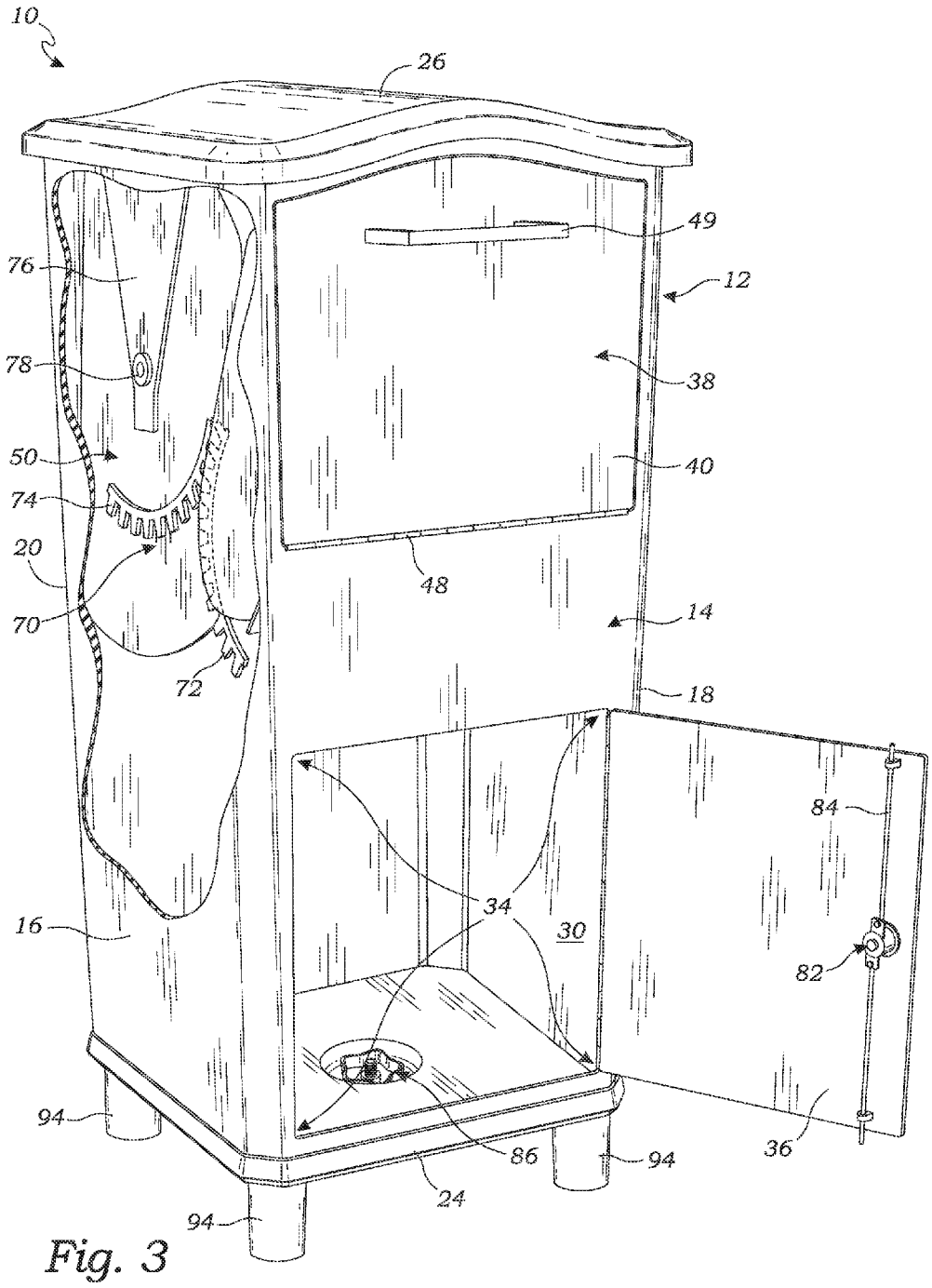
FIG. 3 is a side perspective, cutaway view of the delivery receptacle of FIG. 1.
Figure 5:
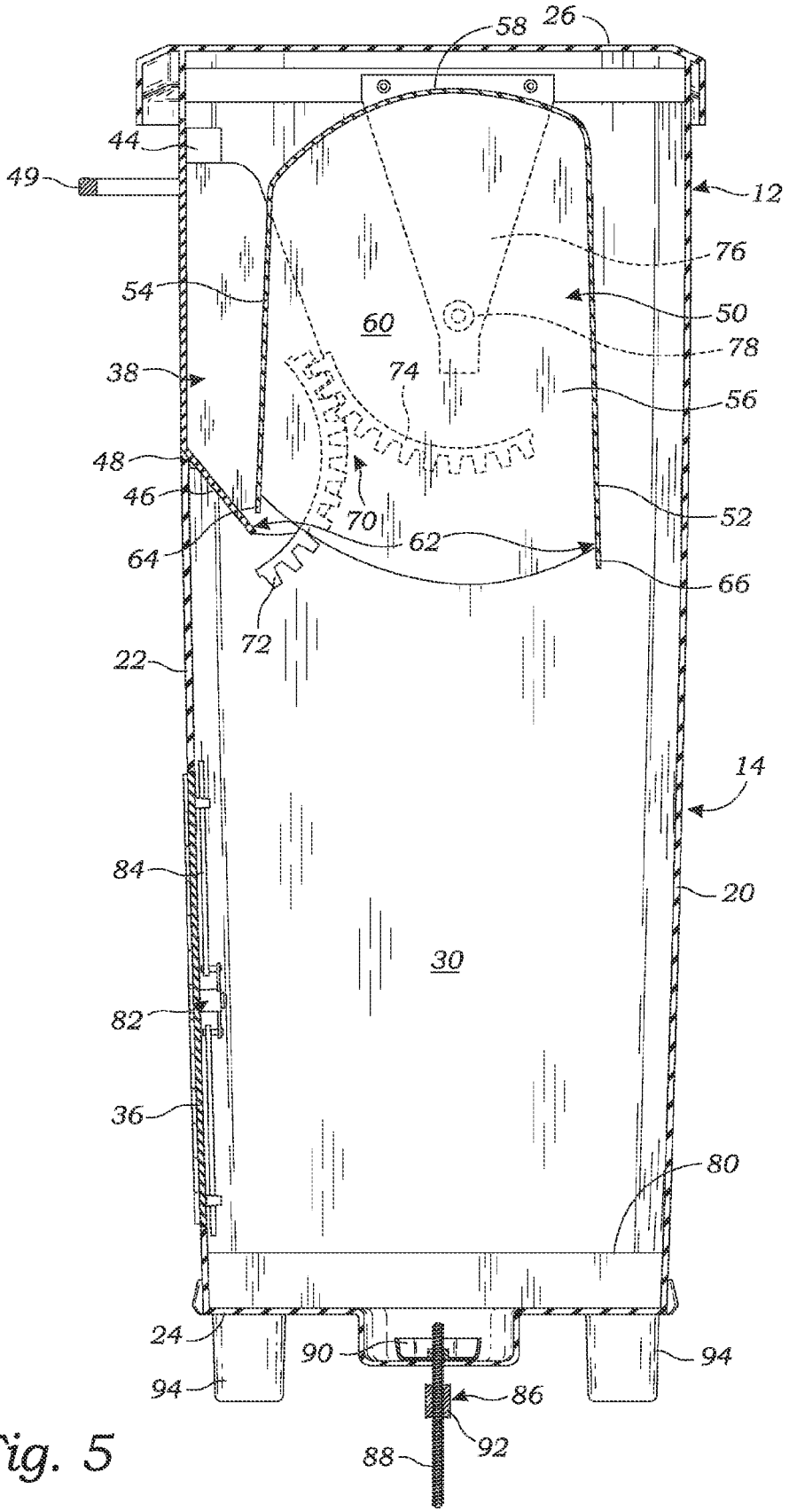
FIG. 5 is a side, sectional view of the delivery receptacle of FIG. 1 with the delivery door in the fully closed position and the drum in the unloading position, according to one embodiment of the present invention.
Figure 9:
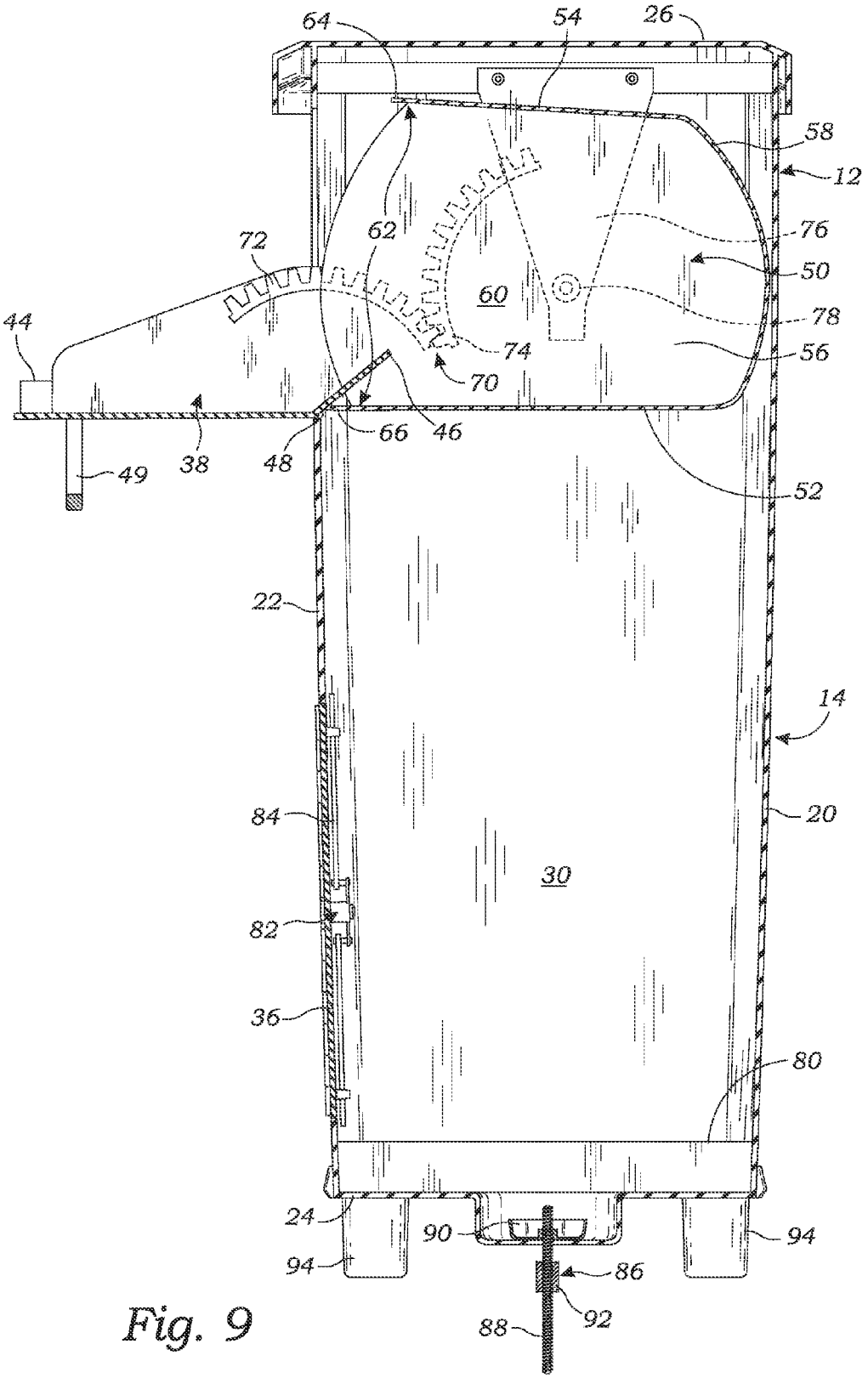
FIG. 9 is a side, sectional view of the delivery receptacle of FIG. 1, with the delivery door rotated to the fully open position.

The drum 50 is rotatable between a loading position when the delivery door 38 is in the fully open position (as shown in FIGS. 3 and 9), and an unloading position when the delivery door 38 is in the fully closed position (as shown in FIGS. 2 and 5). In the loading position, the drum access opening 62 is aligned with the input opening 28 such that an object can be inserted through the input opening 28 into the drum chamber 60. In the unloading position, the drum access opening is aligned with a pathway to a drop area, which in this embodiment is a storage compartment 30, as described below.

The drum roof 54 has a drum roof lip 64 which is adjacent the top of the input opening 28 when the drum 50 is in the loading position, and adjacent the bottom of the input opening 28 and also the extension flap 46 when the drum 50 is in the unloading position. The drum floor 52 has a drum floor lip 66 which is adjacent the bottom of the input opening 28 when the drum 50 is in the loading position.

Figure 4:
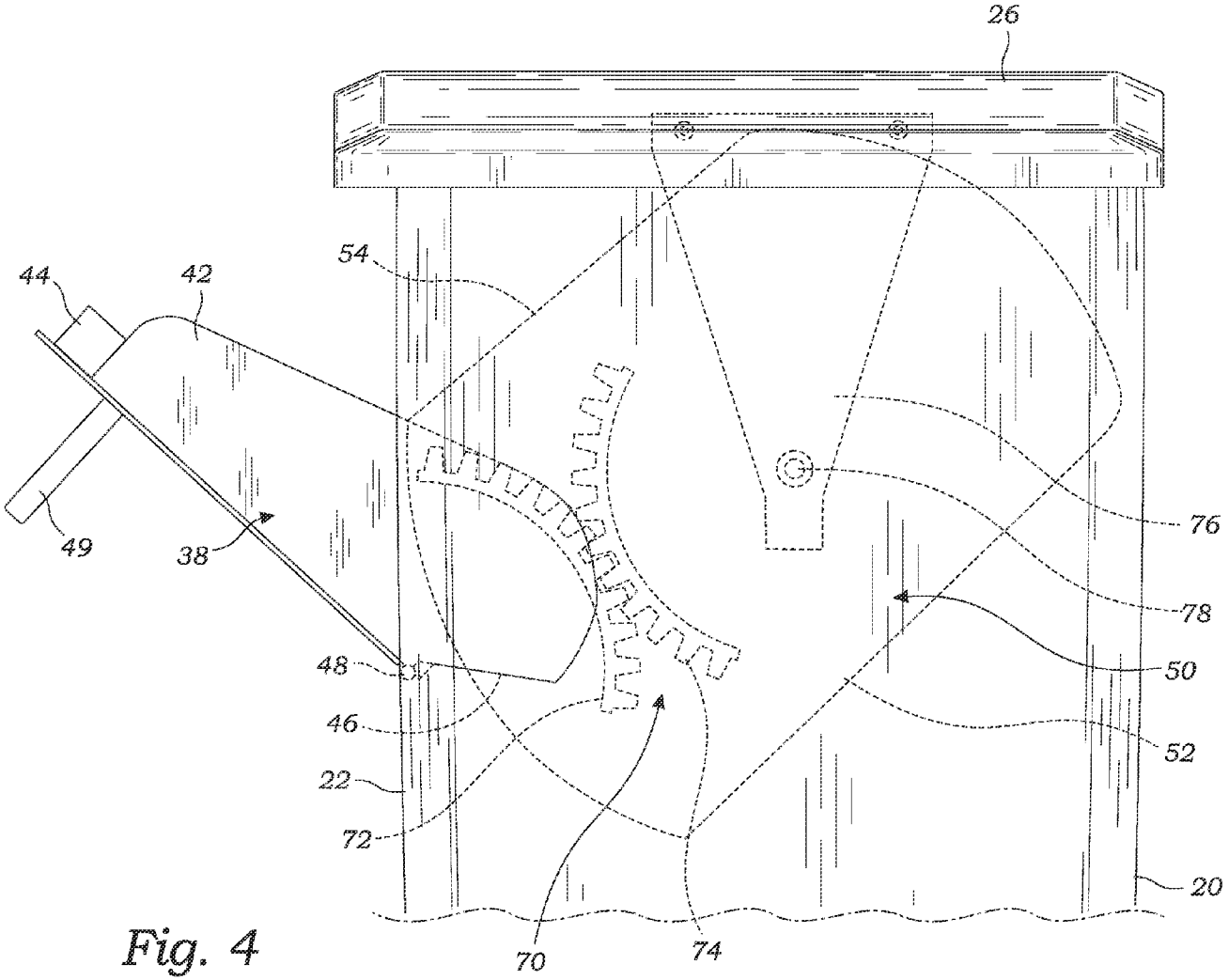
FIG. 4 is an enlarged, partial side view of the delivery receptacle of FIG. 1, with the delivery door rotated partially from the fully closed position toward the open position showing the mating gears of the linking mechanism.
Figure 14:
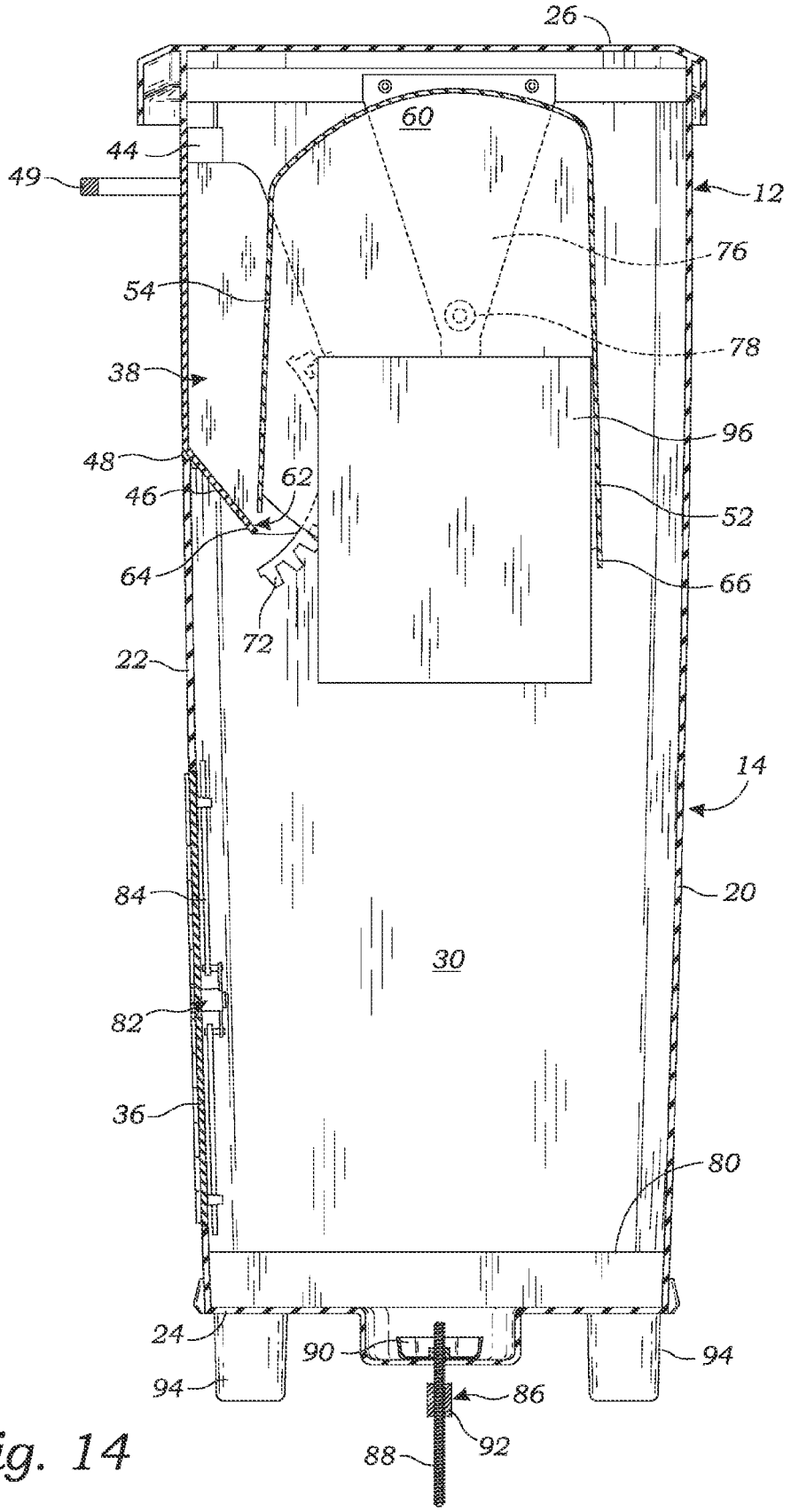
FIG. 14 is a side, sectional view of the delivery receptacle of FIG. 1, with the delivery door rotated to the fully closed position and showing the parcel sliding off the drum floor toward the storage compartment.

Referring now to FIG. 4, a linking mechanism 70 mechanically couples the delivery door 38 to the drum 50 such that rotation of the delivery door 38 causes the drum 50 to rotate. The linking mechanism 70 is configured such that rotation of the delivery door 38 in a first rotational direction between the open position and the closed position causes the drum 50 to rotate in an opposite rotational direction (a second rotational direction) between the loading position and the unloading position. For instance, as shown in FIGS. 5-9, as the delivery door 38 is rotated counterclockwise from the fully closed position (FIG. 5) to the fully open position (FIG. 9), the drum 50 rotates clockwise from the unloading position (FIG. 5) to the loading position (FIG. 9). The delivery door 38, drum 50 and linking mechanism 70 are configured such that when the delivery door 38 is in the fully open position, the drum 50 is in the loading position (FIG. 9); and when the delivery door 38 is in the fully closed position, the drum 50 is in the unloading position (FIGS. 5 and 14).

In the closed position of the receptacle 10, with the delivery door 38 in the fully closed and the drum 50 in the unloading position, the delivery door 38 may be substantially vertical or within plus or minus 15 degrees of vertical, and the drum floor 52 may be substantially vertical or at least at an acute angle (greater than 45°) to horizontal, more particularly an angle of from 60° to 100°, or from 60° to 75°. The orientation of the drum floor 52 in the unloading position ensures that an object will slide off the drum floor 52 and into the storage compartment 30. In the loading position of the receptacle 10, with the delivery door 38 in the fully open position and the drum 50 in the loading position, the delivery door 38 may be substantially horizontal, or within plus or minus 20 degrees of horizontal, and the drum floor may be substantially horizontal, or within plus or minus 20 degrees of horizontal. In this fashion, in the loading position of the receptacle 10, the delivery door 38 and drum floor 52 are substantially aligned such that an object can be conveniently slid across the delivery door 38 and into the drum chamber 60.

In the embodiment of FIGS. 1-20, the linking mechanism 70 comprises a first pair of gears 72 disposed on the delivery door 38 and a second pair of gears 74 disposed on the drum 50. One of the gears 72 is disposed on the inner surface of each of the side panels 42 of the delivery door 39. One of the gears 74 is disposed on the outer surface of each of the side panels 56 of the drum 50. Each of the first gears 72 mate with a respective second gear 74 such that rotation of the first gear 72 in a first rotational direction causes the second gear 74 to rotate in the opposite rotational direction.

In the illustrated embodiment, the first gears and second gears are at a 1:1 ratio, such that rotation of the delivery door 38 through a first rotational angle causes the drum to rotate in the opposite direction by the same rotational angle but in the opposite direction. The gear ratio of the first gears and second gears may be other than 1:1. For example, the ratio between the first gears and second gears may be between 0.5:1 to 2:1, or from 0.75:1 to 1.5:1. Varying the gear ratio will allow for faster or slower, or more or less relative rotation, if so desired.

In an alternative embodiment, the linking mechanism 70 may comprise one or more linking devices, such as linking bars, chains, or other devices that transfer rotation of the delivery door 38 to counter-rotation of the drum 50. In still another alternative embodiment, the linkage 70 can configured such that rotation of the drum and delivery door is in the same rotational direction. In other words, the drum 50 can rotate forward (clockwise) as the delivery door 38 is closed, if so desired.

The embodiment of the receptacle 10 in FIGS. 1-9 is a stand-alone model in which the housing 12 has a drop area in the form of a storage compartment 30 below the drum 50. As described below, objects deposited into the receptacle 10 drop from the drum 50 into a drop area which is a storage compartment 30 in the described embodiment. Alternatively, the drop area may be a storage cart, or other secure storage area. For example, the receptacle of the present invention may be a structure mounted unit (such as a wall or other supporting structure) to which the receptacle is mounted allowing objects to be placed into the receptacle on one side of the structure and then deposited into a drop area on the other side of the structure.

A storage compartment pad 80 may be provided on the bottom 24 of the housing 12 to cushion the fall of objects dropping from the drum 50. The storage compartment pad 80 may be waffled and have drainage holes to allow water to drain through the pad 80 to the bottom wall 24. A floor of the storage compartment 30 may be movable and/or adjustable to adjust the capacity of the storage compartment and also to reduce the falling distance of objects dropping from the drum 50 into the storage compartment 30. For instance, the floor of the storage compartment may be spring loaded such that it cushions the impact of an object falling on the floor of the storage compartment 30, and also automatically adjusts the size of the storage compartment as objects are deposited into the receptacle 10. Alternatively, the floor of the storage compartment 30 may have adjustable stops, such as pegs or other suitable mechanism, to manually adjust the position of the floor. An object redirector or ramp may also be disposed within the storage compartment, typically along the back wall 20. When an object being deposited into receptacle 10 falls into the storage compartment 30, it hits the redirector and is pushed toward the front of the storage compartment 30 nearer the object removal opening 34.

The housing 12 has an object removal opening 34 (see FIGS. 3 and 16) covered by an access door 36 which can be opened to provide access to the storage compartment 30 through the removal opening 34 to remove an object from the storage compartment 30. The removal opening 34 and access door 36 are sized such that any object the receptacle 10 can receive can subsequently fit through the opened access door 36. The access door 36 may have a locking latch 82 which can be locked to secure the storage compartment 30 and unlocked to open the access door 36. The locking latch 82 may be unlocked using a key, keycard, combination lock, fingerprint reader, biometric lock, remote activated lock (e.g. activated through WiFi or cellular phone communication) or other suitable locking device. The lock may also be a one-time use lock which would allow a delivery service to retrieve an outgoing article placed in the storage compartment 30 and then automatically lock the lock 82 on the access door 36.

The locking latch 82 can be a simple latch having a single latch, or it can have a bar linkage 84 that engages the housing 12, such as a frame or other structure of the housing 12. For instance, a three-point or multi-point locking system strengthens theft prevention. The access door 36 may be positioned in a recessed flange around its perimeter to minimize the gap into which a screwdriver or other prying instrument can fit. As shown in the illustrated embodiment, the access door 36 latches at the side and is hinged at the opposite side, such that the access door 36 opens to the side so it is completely out of the way of retrieval and remains open unassisted. In other embodiments, the access door 36 may be hinged at the bottom, top or other side, such that the access door opens downward, upward or to the other side. The access door may be hinged at one or more edges to allow multi-directional opening to accommodate various possible physical orientation. The access door 36 may also be hinged vertically or horizontally at one or more locations across its surface to allow accordion-type opening and closing. This type of arrangement may be desirable, for example, to prevent the access door 36 from resting on the ground where it could be damaged and/or obstruct access to the storage compartment 30.

The receptacle 10 has a ground anchor assembly 86 for securing the receptacle 10 to the ground or other stationary object, such as a structural wall, etc. The ground anchor assembly comprises a mounting bolt 88 which extends through a hole in the bottom wall 24 of the housing 12. A hand-tighten nut 90 threads onto the first end of the mounting bolt 88 to secure the ground anchor assembly 86 to the receptacle 10. One or more mounting bracket(s) 92 threads onto the second end of the mounting bolt 88 and has a device for securing the anchor assembly 86 to the ground or other secured structure or wall.

The receptacle 10 also has a plurality of legs 94 (in this case 4 legs) extending from the bottom wall 24 of the housing 12. The legs 94 may have alternative heights and styles for different ground types and surfaces. The legs 94 may also be fixed, removable and/or adjustable (e.g. adjustable height).

The operation of the receptacle 10, including the rotational movement of the delivery door 38 and the drum 50, will now be described with reference to FIGS. 5-7. In FIG. 5, the delivery door 38 is in the fully closed position oriented substantially vertically and completely blocks the input opening 28 in the housing 12, while the drum 50 is in the unloading position with the drum floor 52 oriented substantially vertically.

Figure 6:
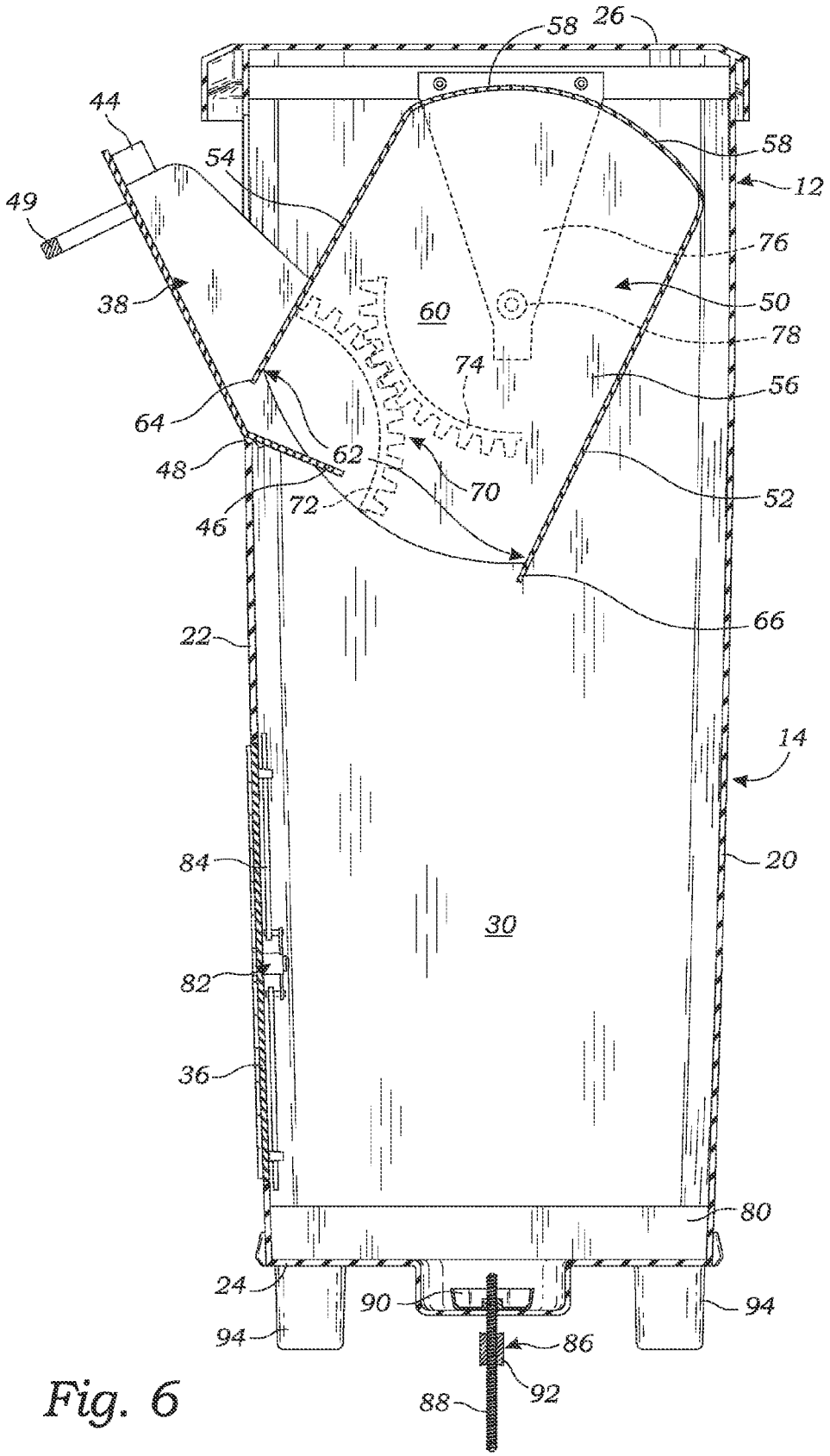
FIG. 6 is a side, sectional view of the delivery receptacle of FIG. 1, with the delivery door rotated partially from the fully closed position toward the open position.

As shown in FIG. 6, the delivery door 38 is opened by pulling outwardly and downwardly on the handle 49, thereby rotating the delivery door 38 in a counter-clockwise direction and partially uncovering the input opening 28. As the delivery door 38 is rotated toward the open position, the gears 72 on the delivery door 38 rotate the gears 74 on the drum 50 causing the drum 50 to rotate in the opposite direction, i.e. in a clockwise direction. The relative movement and positioning of the extension flap 46 of the delivery door 38, the drum roof lip 64, and the drum floor lip 66 ensure that there is no direct and straightforward access, or line of sight, through the uncovered portion of the input opening 28 into the storage compartment 30. This configuration restricts unwanted access to the storage compartment 30, thereby maintaining an appropriate level of security against theft and/or vandalism.

Figure 7:
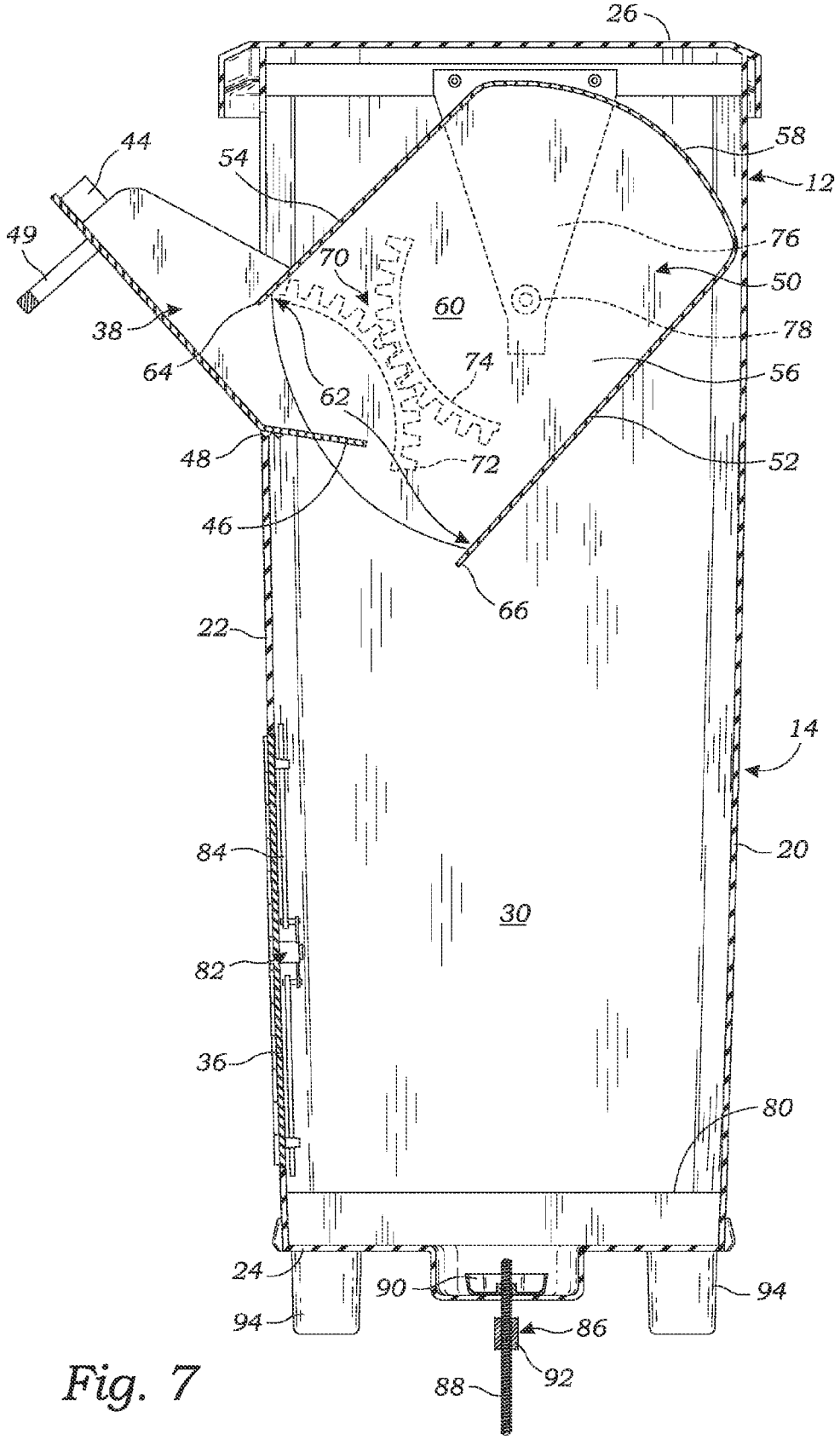
FIG. 7 is a side, sectional view of the delivery receptacle of FIG. 1, with the delivery door rotated even further toward the open position.
Figure 8:
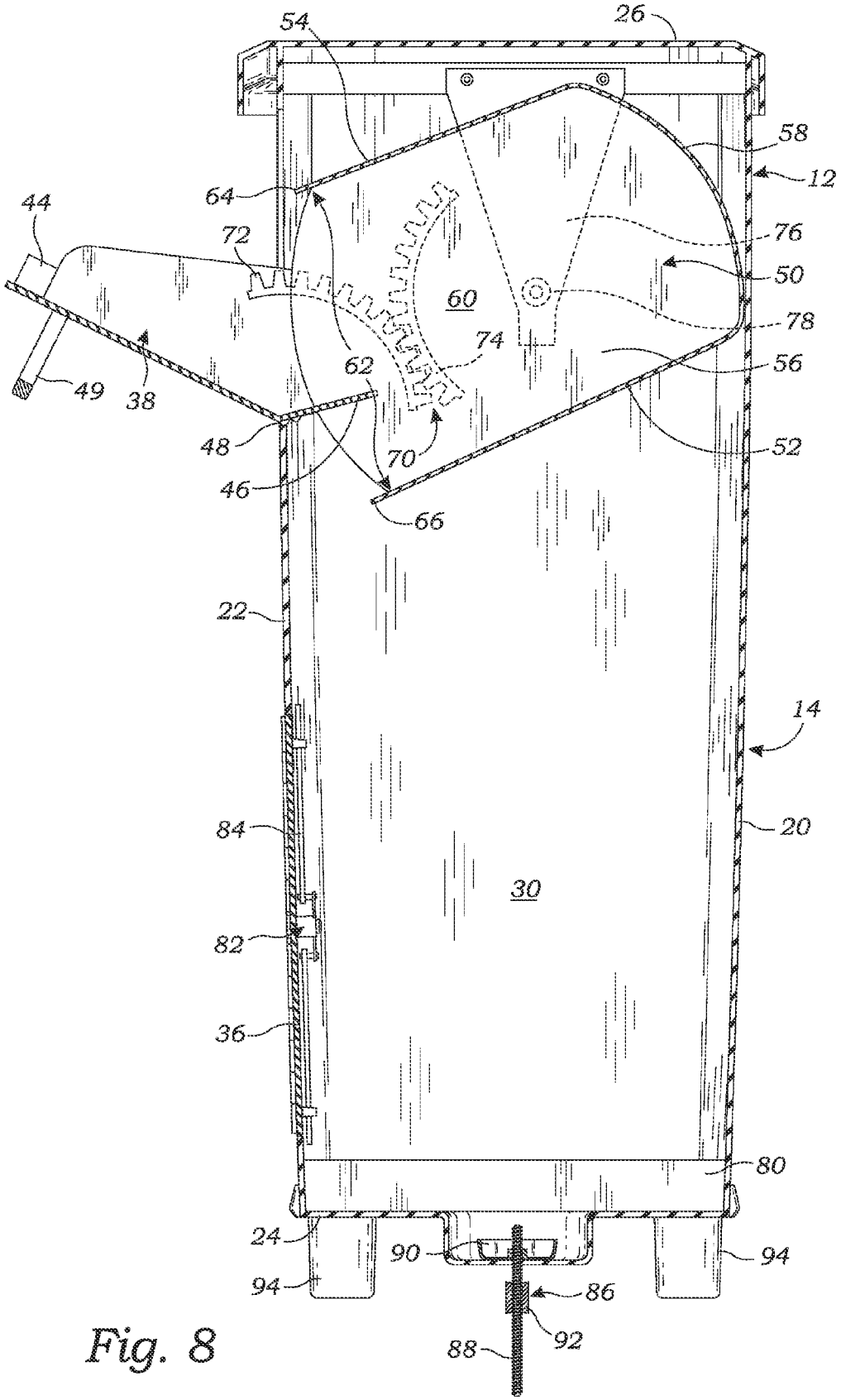
FIG. 8 is a side, sectional view of the delivery receptacle of FIG. 1, with the delivery door rotated almost to the fully open position.

FIGS. 7 and 8 show the delivery door 38 as it further rotates clockwise toward the fully open position such that it blocks even less of the input opening 28 and also show the drum 50 as it further rotates counterclockwise toward the loading position. It can be seen that the relative movement and positioning of the extension flap 46 of the delivery door 38, the drum roof lip 64, and the drum floor lip 66 continue to prevent no direct and straightforward access, or line of sight, through the uncovered portion of the input opening 28 into the storage compartment 30.

As shown in FIG. 9, the delivery door 38 is further rotated counterclockwise to the fully open position such that it allows substantially clear of the input opening 28, providing free access through the input opening 28 to place an object into the drum chamber 60. At the same time, the drum 50 has further rotated clockwise to the loading position, with the drum access opening 62 aligned with the input opening 28. The delivery door 38 is oriented substantially horizontally and the drum floor 52 is oriented substantially horizontally. The extension flap 46 extends slightly into the drum chamber 60 and blocks the gap between the input opening 28 and the drum floor 52 such that there is no direct access or line of sight through the input opening 28 and into the storage compartment 30.

Figure 10:
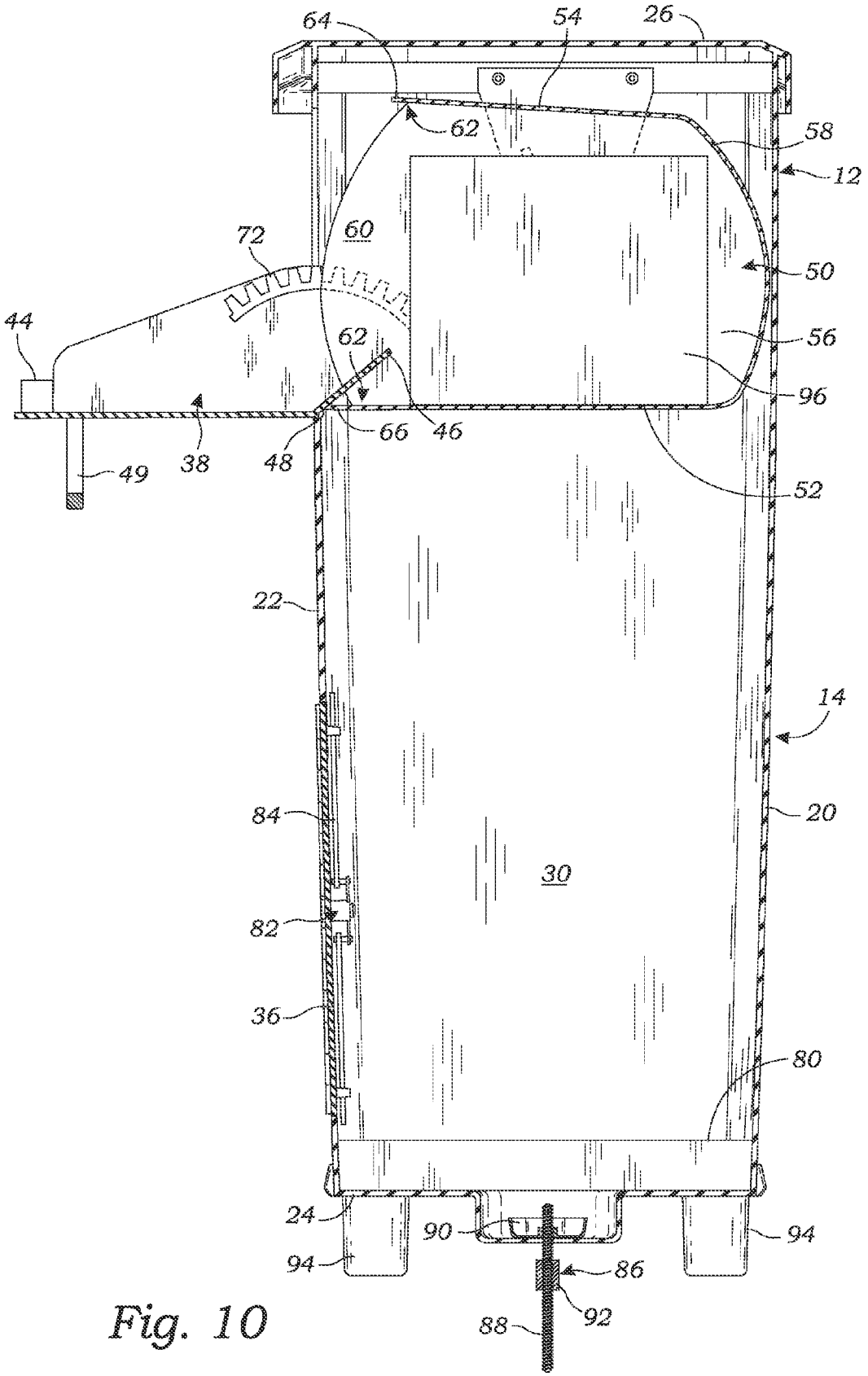
FIG. 10 is a side, sectional view of the delivery receptacle of FIG. 1, with a parcel being inserted into the drum chamber with the delivery door in the fully open position.

FIG. 10 shows a parcel 96 which has been inserted through the input opening 28, through the drum access opening 62, and completely into the drum chamber 60, with the delivery door 38 in the fully open position and the drum 50 in the loading position.

Figure 11:
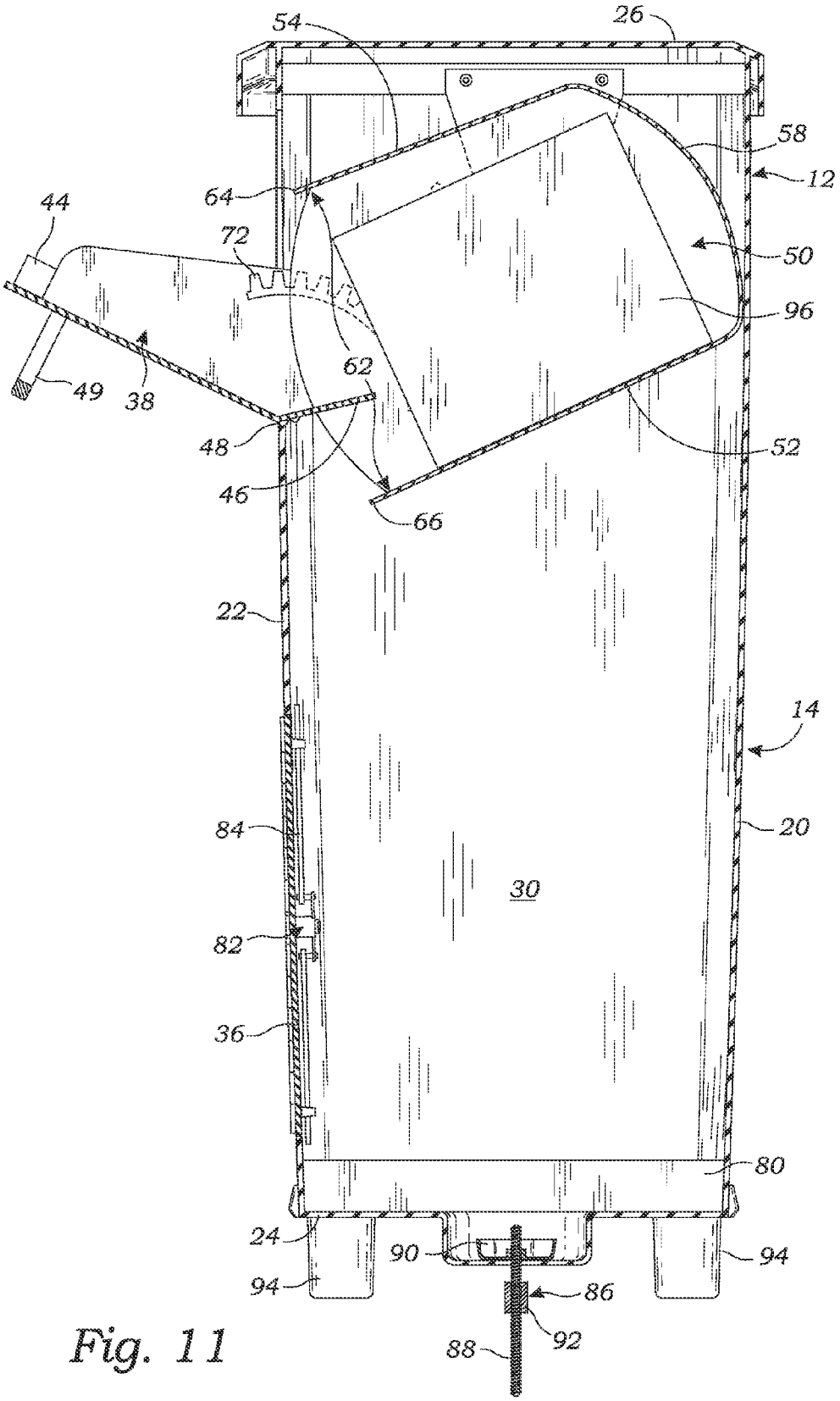
FIG. 11 is a side, sectional view of the delivery receptacle of FIG. 1, with a parcel inserted into the drum chamber and the delivery door rotated partially from the fully open position toward the closed position.

As shown in FIG. 11, the delivery door 38 is now rotated in the opposite direction (clockwise direction), toward the closed position. As the delivery door 38 is rotated toward the closed position, it begins to partially block the input opening 28. The clockwise rotation of the delivery door 38 causes the drum 50 to rotate in the opposite rotational direction (i.e. counterclockwise) toward the unloading position and the drum floor 52 tilts downward.

Figure 12:
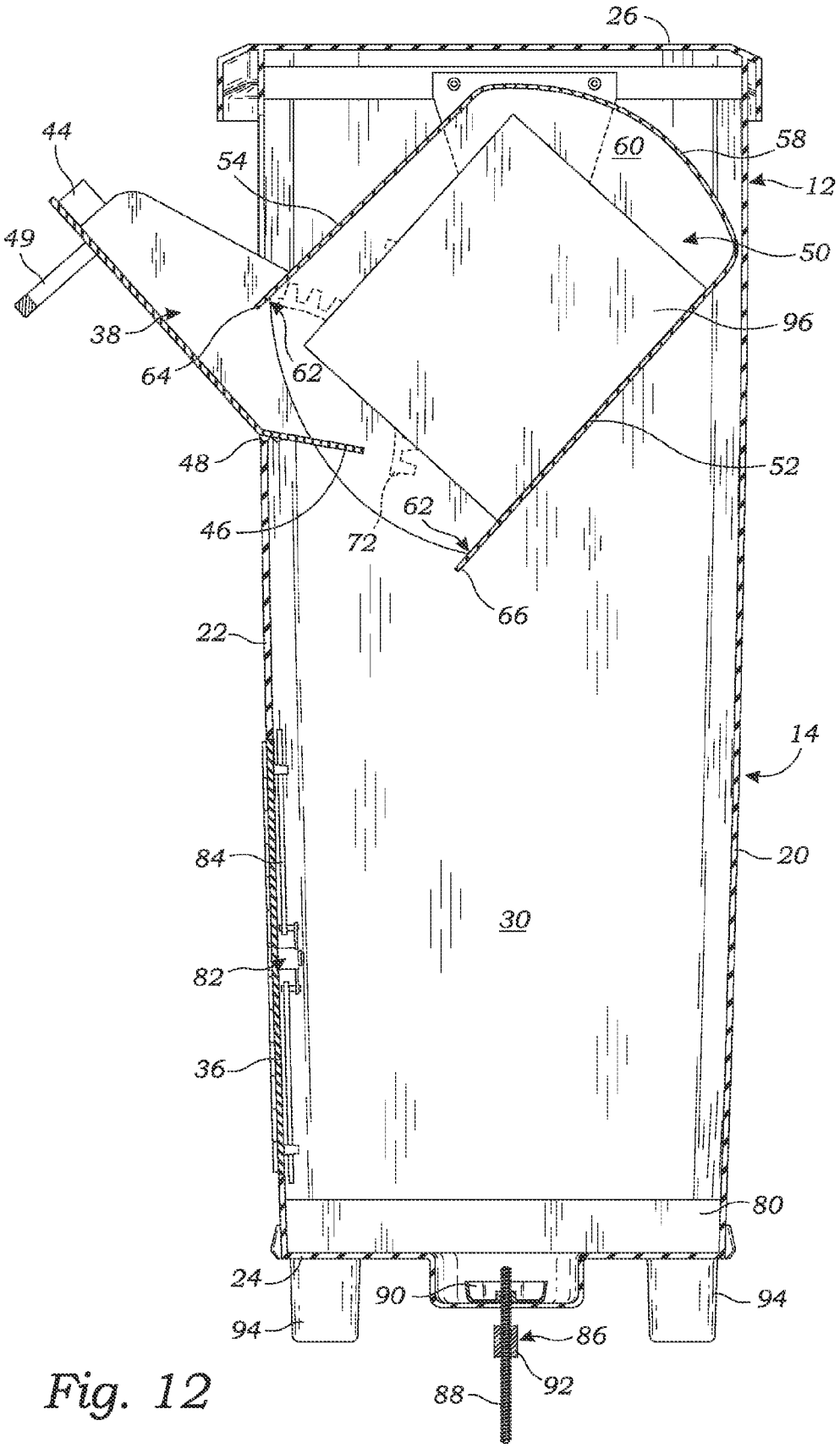
FIG. 12 is a side, sectional view of the delivery receptacle of FIG. 1, with a parcel inserted into the drum chamber and the delivery door rotated even further toward the closed position.

In FIG. 12, the delivery door 38 is further rotated toward the closed position, and the drum 50 is further rotated toward the unloading position. The delivery door 38 covers more of the input opening 28, and the drum floor 52 tilts further downward.

Figure 13:
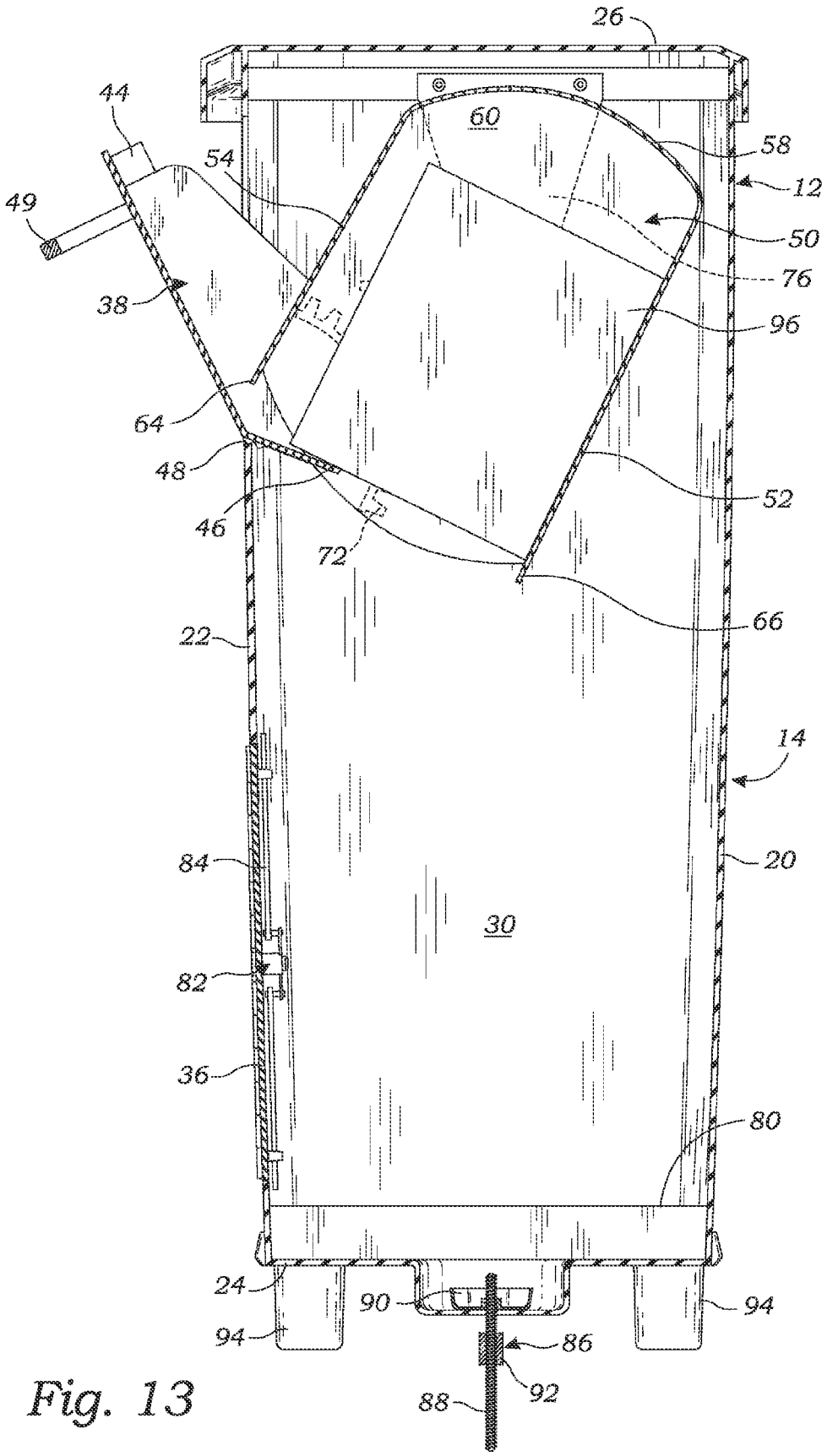
FIG. 13 is a side, sectional view of the delivery receptacle of FIG. 1, with a parcel inserted into the drum chamber and the delivery door rotated even further toward the closed position.

As shown in FIG. 13, the delivery door is even further rotated toward the closed position, and the drum is further rotated toward the unloading position. The delivery door 38 now blocks much of the input opening 28. The drum floor 52 tilts steeply downward such that the parcel 96 may slide downward until it bears against the extension flap 46 which keeps the parcel 96 from getting stuck against the bottom edge of the input opening 28.

In FIG. 14, the delivery door 38 has been rotated back to the fully closed position, and the drum has been rotated back to the unloading position, the same positions as in FIG. 5. The delivery door 38 again completely blocks the input opening 28. The drum floor 52 is substantially vertical, and the extension flap 46 has moved out of the way of the parcel 96, such that the parcel 96 begins sliding downward out of the drum chamber 60 and into the storage compartment 30.

Figure 15:
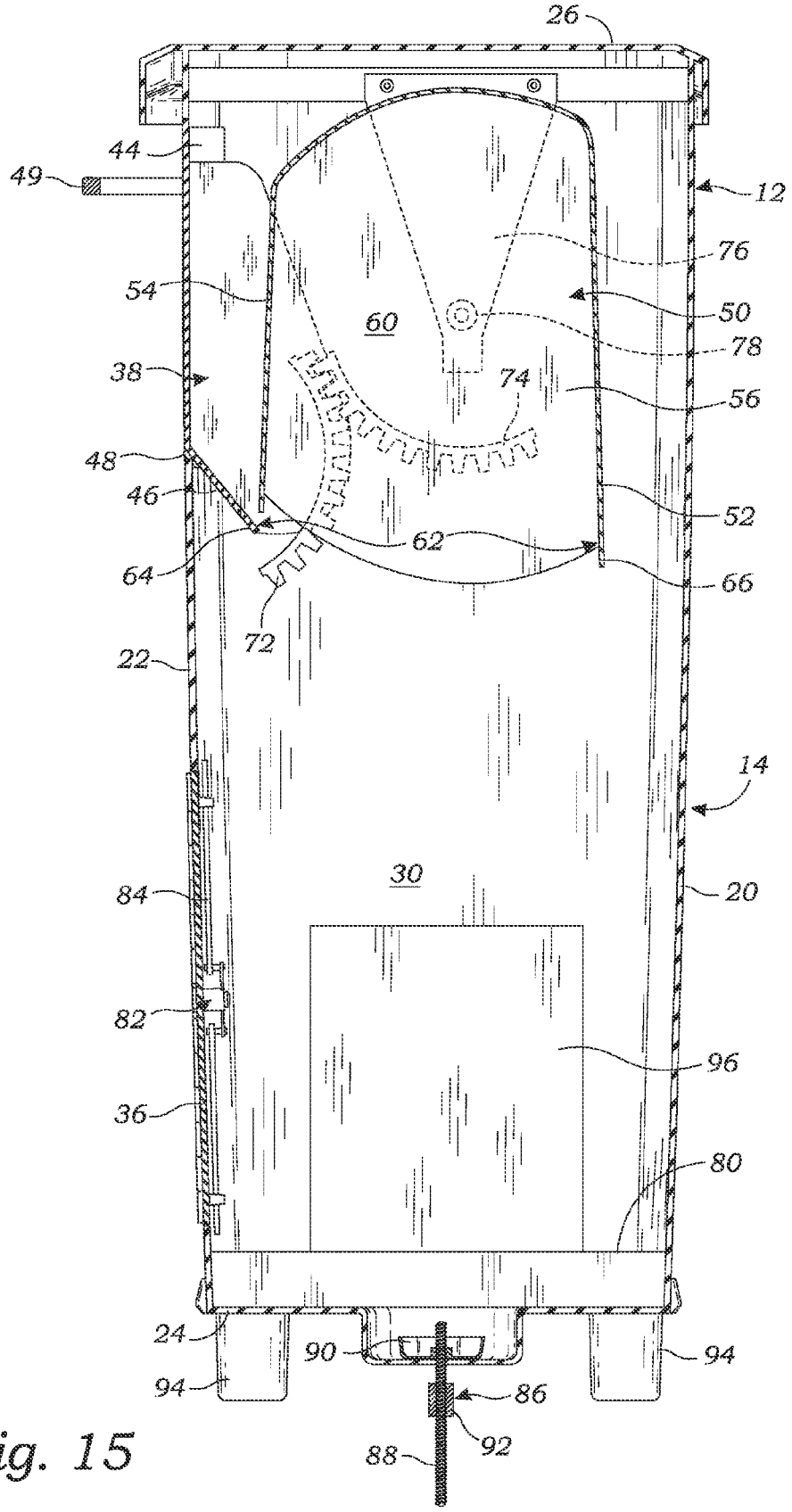
FIG. 15 is a side, sectional view of the delivery receptacle of FIG. 1, with the delivery door rotated to the fully closed position and showing the parcel after it has slid completely off the drum floor and into the storage compartment.
Figure 16:
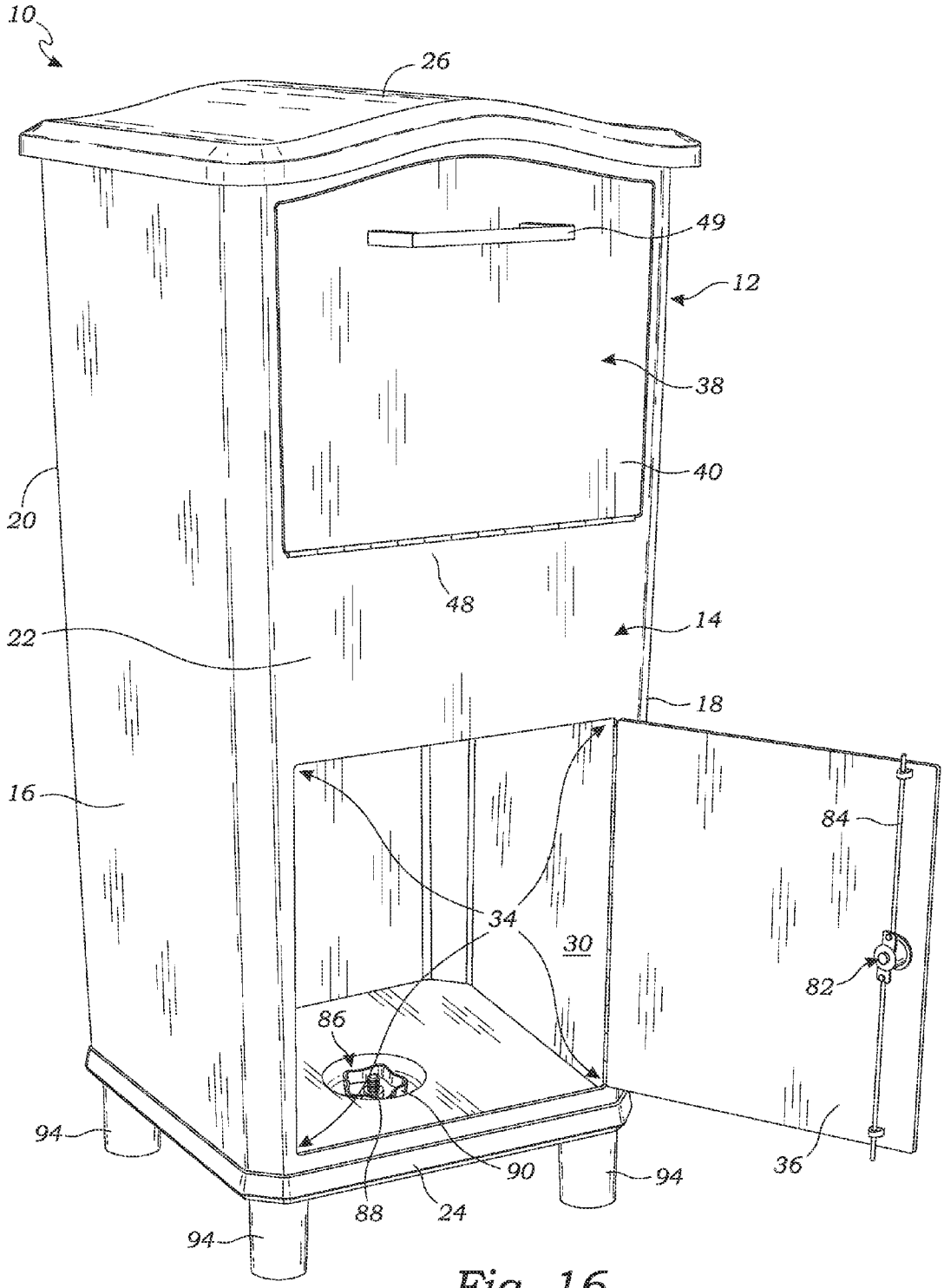
FIG. 16 is a side perspective view of the delivery receptacle of FIG. 1 with the access door in open position.

In FIG. 15, the parcel 96 has slid completely out of the drum chamber 60 and has dropped into the storage compartment 30 onto the storage compartment pad 80 which cushions the fall of the parcel 96.

As described above with respect to FIGS. 3 and 16, the parcel 96 may be removed from the storage compartment 30 by unlocking and unlatching the locking latch 82 and opening the access door 36. The parcel 96 can then be removed through the object removal opening 34. The access door 36 may then be closed, latched and locked, and the receptacle 10 is ready to receive another object.

Figure 17:
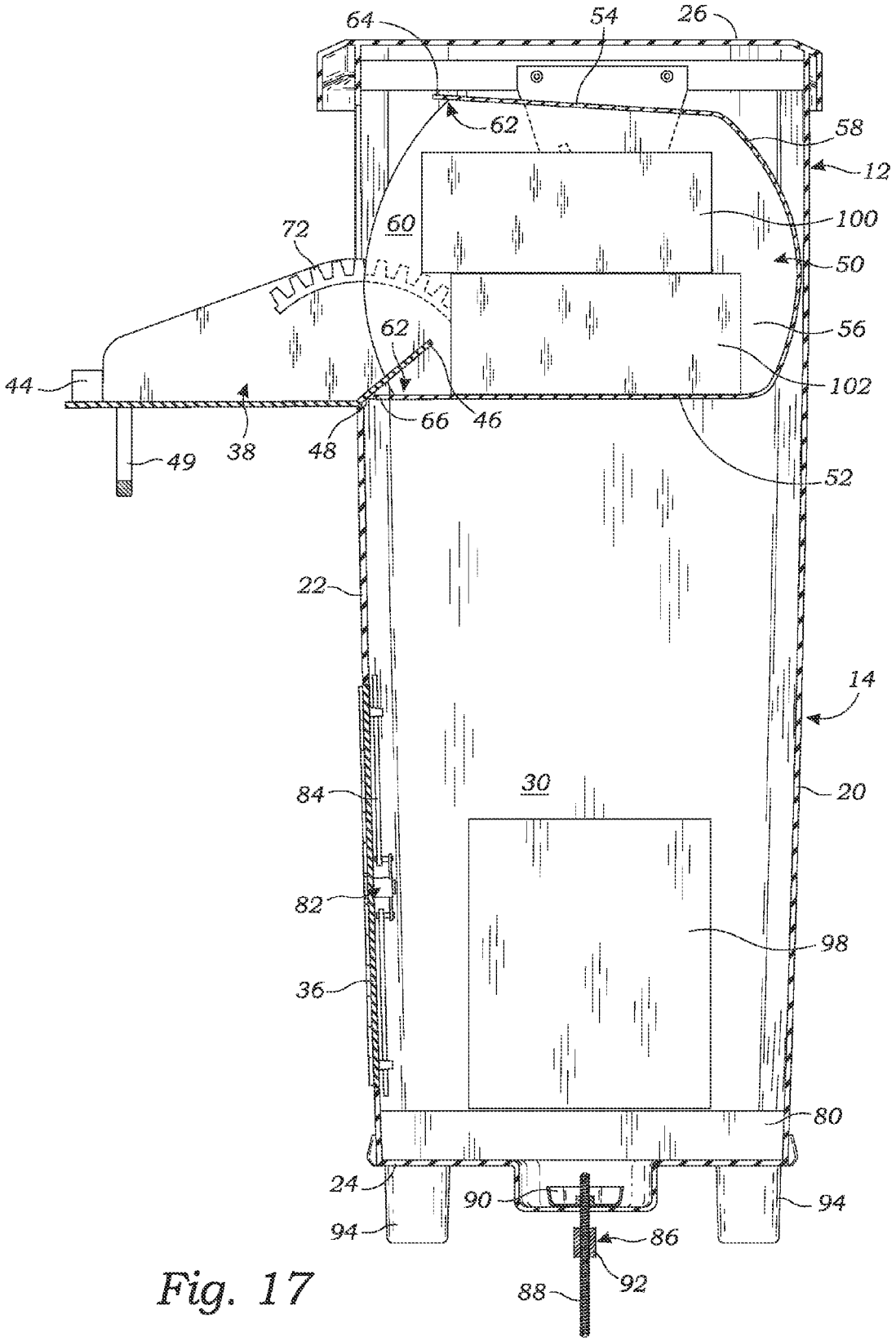
FIG. 17 is a side, sectional view of the delivery receptacle of FIG. 1 with the delivery door in the full open position and with multiple parcels inserted into the drum chamber and another parcel positioned in the storage compartment.

As illustrated in FIG. 17, the receptacle 10 is capable of receiving and storing multiple objects and multiple deliveries. For instance, two or more objects 100 and 102 can be loaded into the drum chamber 60, and then dropped into the storage compartment by closing the delivery door 38, as described above. Furthermore, a first object from a first delivery can be stored in the storage compartment 30, and then additional object(s) can be loaded into the receptacle 10 in a subsequent second delivery (such as a delivery of the object 100 and 102, a shown in FIG. 17). Additional objects can be loaded into the receptacle 10 in additional deliveries until the storage compartment 30 is full.

In another feature of the present invention, the receptacle 10 may be equipped with a storage compartment level sensor which detects how full the storage compartment is (such as the total height of the objects in the storage compartment), and has an interlock which automatically locks the delivery door when the storage compartment is full to prevent any further deliveries. The interlock may be an electronic or mechanical interlock.

Figure 18:
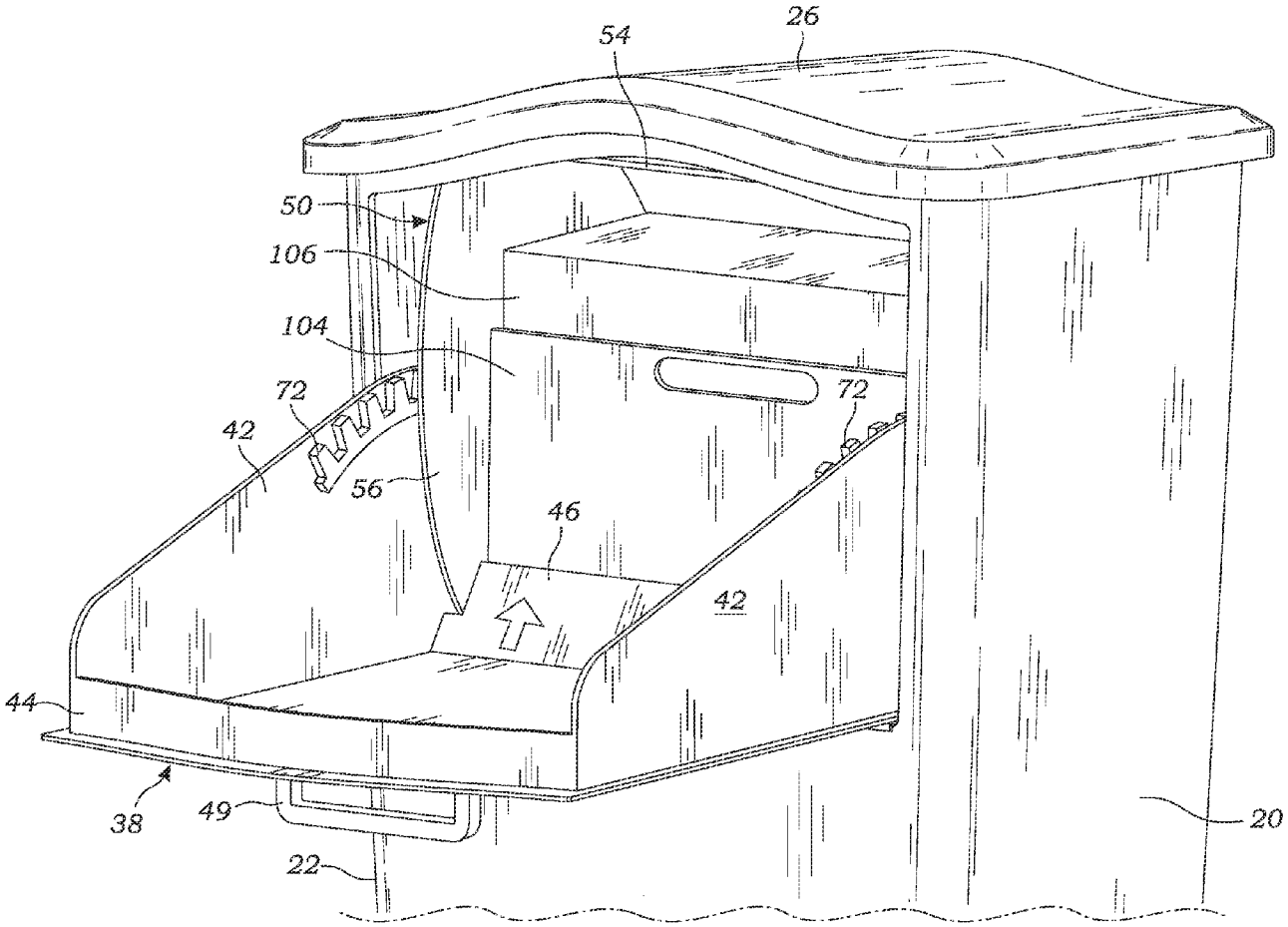
FIG. 18 is an enlarged, partial perspective view of the delivery receptacle of FIG. 1, with a retaining device installed for outgoing parcels, and the delivery door in the fully open position.
Figure 19:
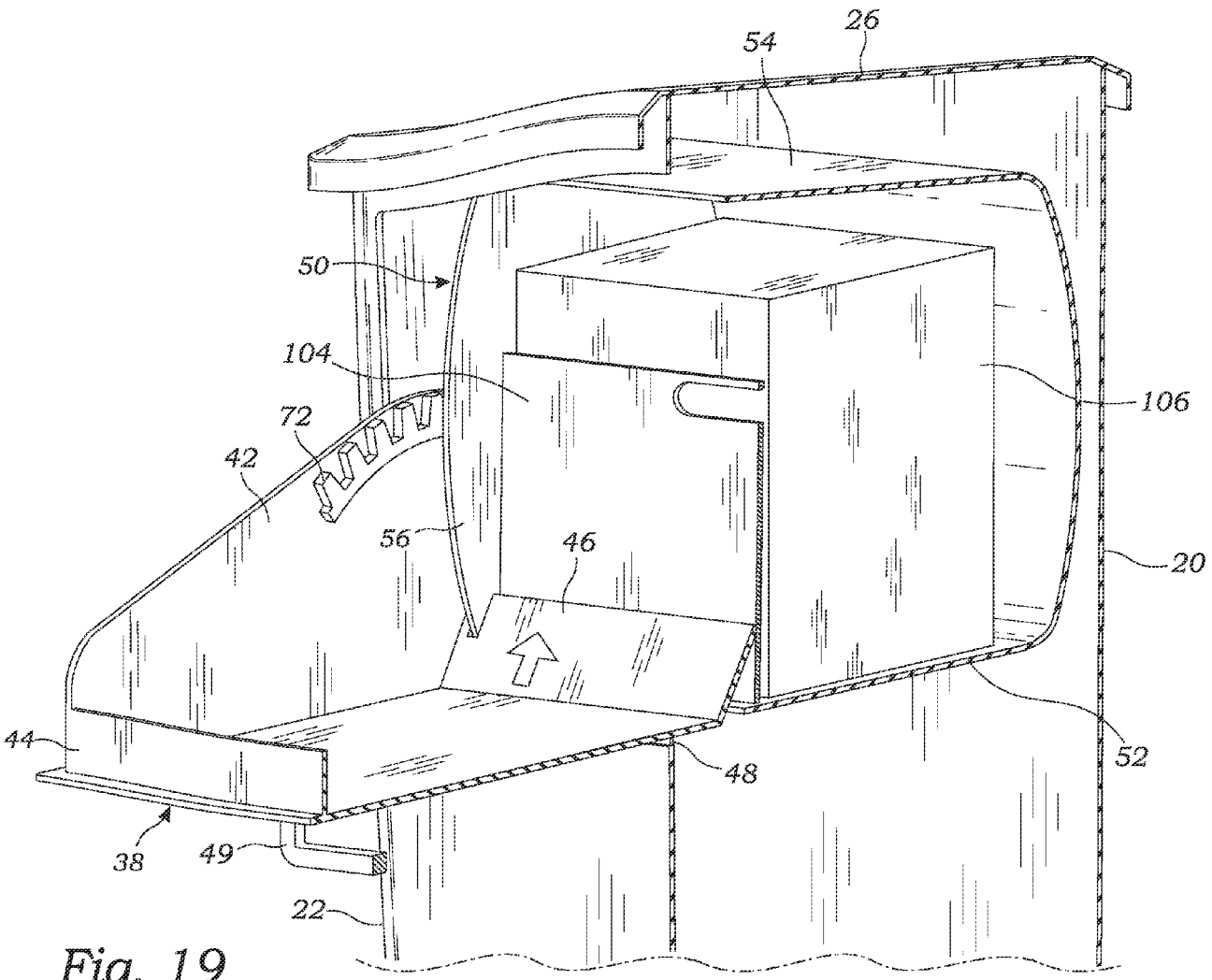
FIG. 19 is an enlarged, partial, perspective, sectional view of the delivery receptacle of FIG. 1, with a retaining device installed for outgoing parcels, and the delivery door in the fully open position.
Figure 20:
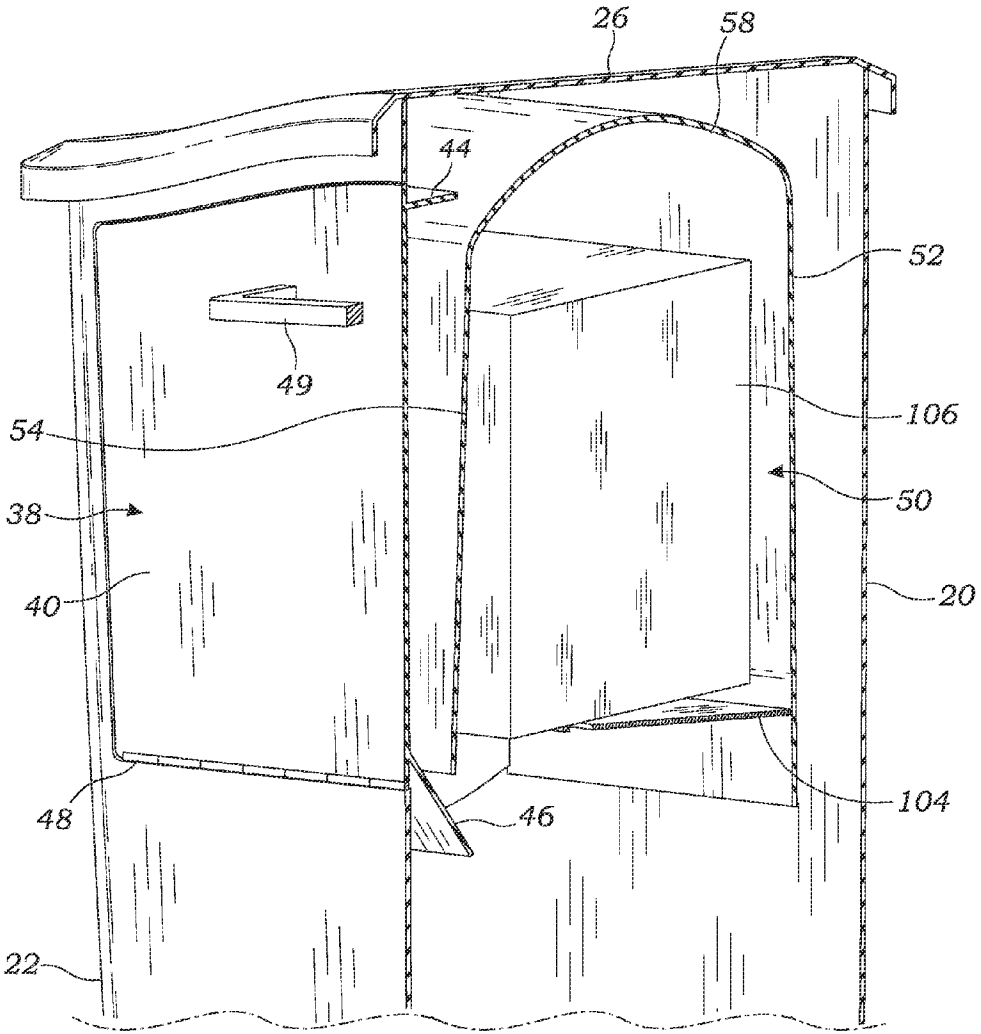
FIG. 20 is an enlarged, partial, perspective, sectional view of the delivery receptacle of FIG. 1, with a retaining device installed for outgoing parcels, and the delivery door in the fully closed position.

Turning now to FIGS. 18-20, in order to protect outgoing articles from the elements and keep them out of sight from passers-by, an outgoing article retaining device 104 may be added to the drum 50 and delivery door 38 assembly. The retaining device 104 retains the outgoing article 106 in the drum chamber 60 and prevents the article 106 from dropping out of the drum chamber 60 into the storage compartment 30 when the drum 50 is in the unloading position. This allows a delivery person to open the delivery door 38, which rotates the drum 50 to the loading position, and retrieve the outgoing article 104 from the drum chamber 60 and pull it out through the input opening 28. The retaining device 104 may be activated and deactivated from the outside and/or inside of the receptacle 10, by push button, lever, dial, lock, ratchet, or other mechanical means, and/or by a secured electronic means such as a key, keycard, combination lock, fingerprint reader, biometric lock, remote activated lock (e.g. activated through WiFi or cellular phone communication) or other suitable electronic device. After a delivery person removes the outgoing article 106, the delivery person can deactivate the retaining device 104 so that the drum 38 is available to receive an incoming delivery and drop it into the storage compartment 30. Alternatively, the retaining device 104 may automatically deactivate when the outgoing article 106 is removed from the drum chamber 60. The receptacle 10 may be equipped with a visual indicia to indicate the presence of an outgoing article, such as a mechanical or electronic representation of one or more of a mail flag; color-coded image; text, etc., which may be subtle, prominent, user-selectable, or customizable. The outgoing article indicia may be automatically triggered by the presence of an outgoing article in the drum chamber 60, or by the activation of the retaining device 104, or manually, or by other automatic trigger. The trigger may be mechanical, electrical, or electro-mechanical based, such as by a weight sensor, laser sensor, button, switch, etc.

Figure 21:
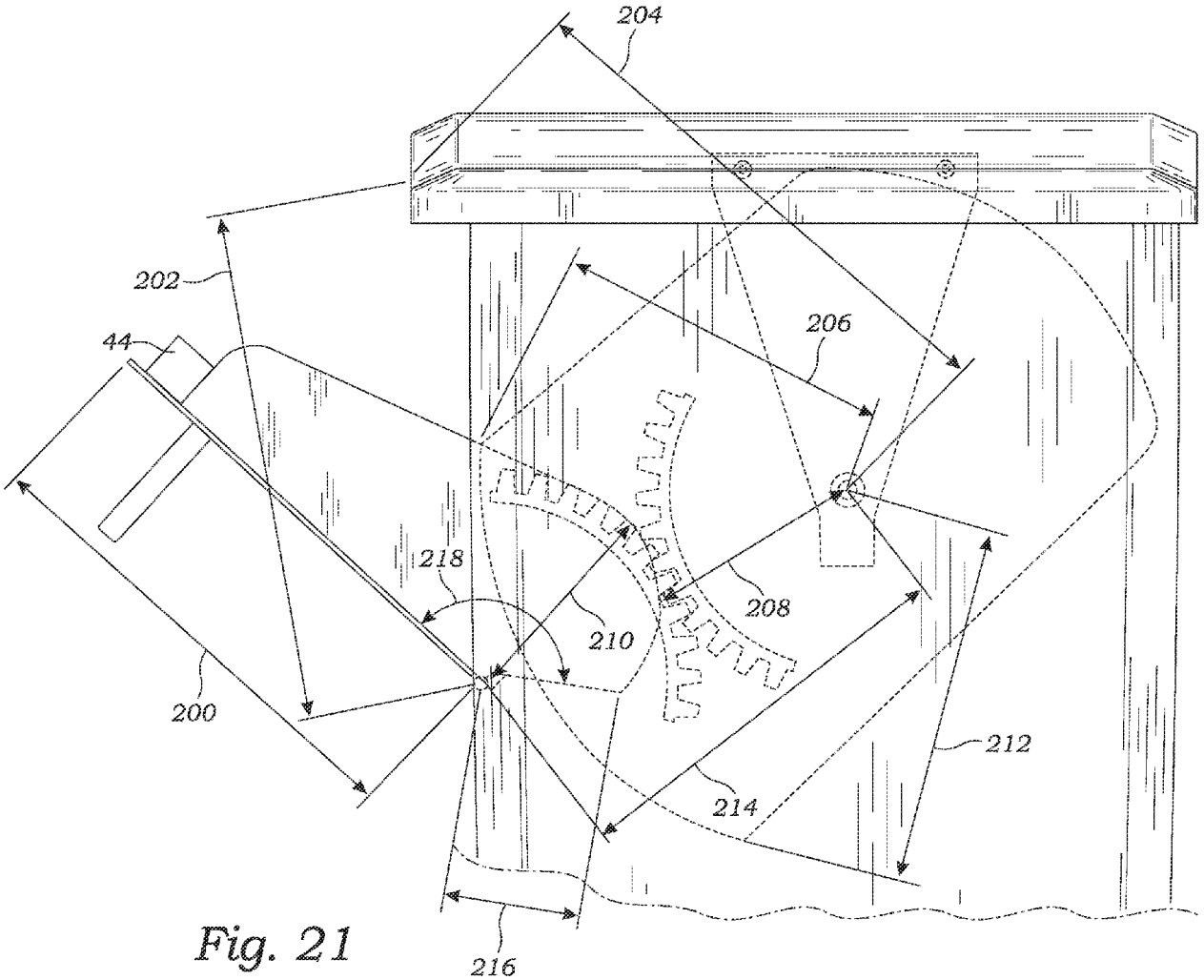
FIG. 21 is an enlarged, partial side view of the delivery receptacle of FIG. 1, with the delivery door rotated partially from the fully closed position toward the open position showing the mating gears of the linking mechanism, and also showing several exemplary dimensions.
Figure 22:
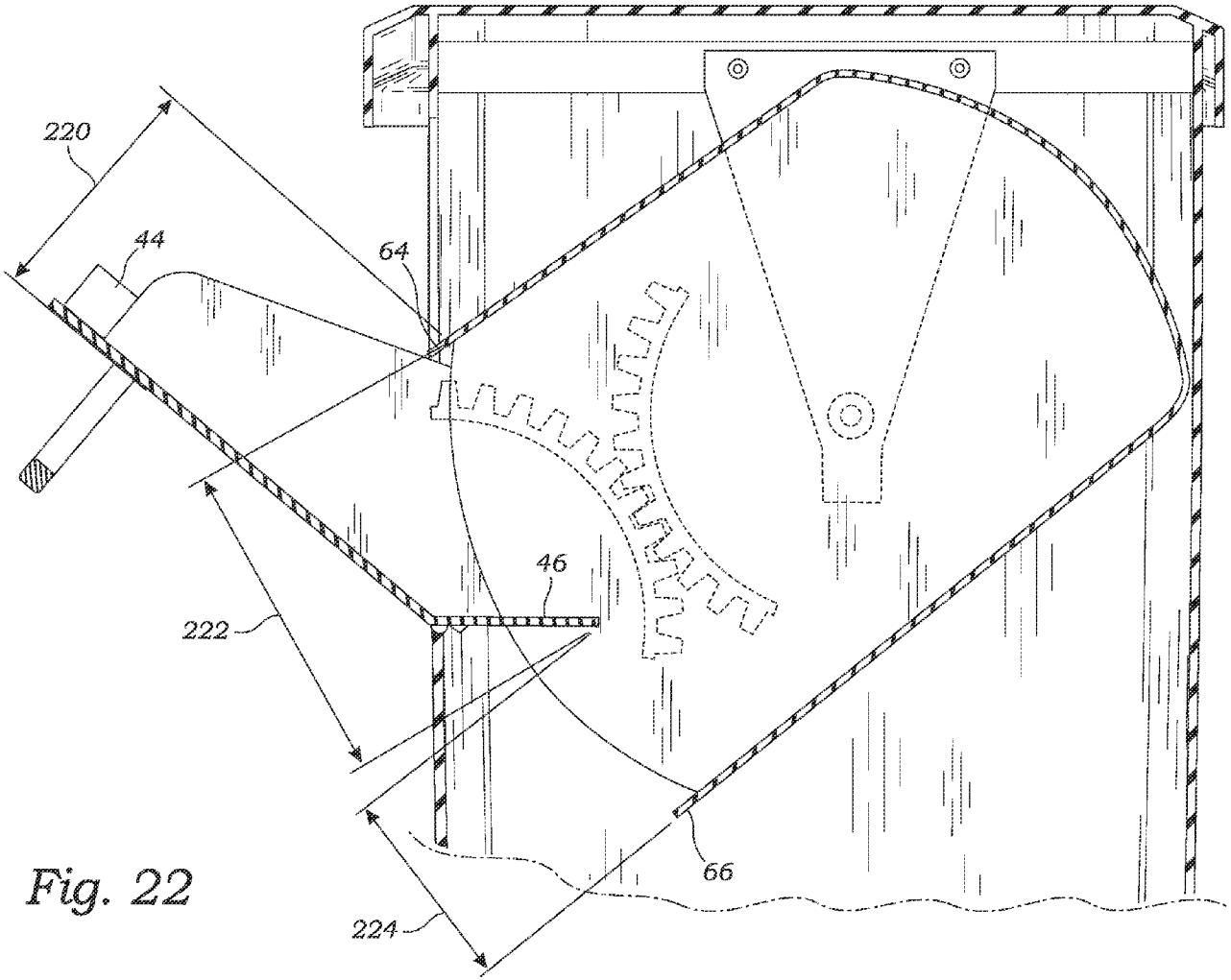
FIG. 22 is an enlarged, partial side view of the delivery receptacle of FIG. 1, with the delivery door rotated partially from the fully closed position toward the open position showing the mating gears of the linking mechanism, and also showing several exemplary dimensions.

As discussed above, the relative movement, positioning and dimensions of the components of the delivery receptacle 10 which work in conjunction to allow for maximizing the deliverable parcel size, while also minimizing the overall size of the receptacle 10, and maintaining an appropriate level of security against fishing and theft. As shown in FIG. 21, the dimensions for an exemplary receptacle 10 are shown, with dimensions as follows: 202-262 mm (10.33 inches); 204-268 mm (10.57 inches); 206-186 mm (7.31 inches); 208-radius 102 mm (4.02 inches); 210-radius 103 mm (4.06 inches); 212-198 mm (7.78 inches); 214-206 mm (8.12 inches); 216-66 mm (2.59 inches). These dimensions will result in certain dimensions of the openings between the components as shown in FIG. 22. In FIG. 22, the preferred ranges for the labeled opening dimensions are as follows: the opening 220 between the drum roof lip 64 and the face of the door 38 is from 0 inches to 5 inches; the opening 222 between the drum roof lip 64 and end of the extension flap 46 is from 0 inches to 10 inches; and the opening 224 between the end of the extension flap 46 and the drum floor lip 66 is from 0 inches to 6 inches.

Many delivery and courier services use devices to electronically confirm delivery of a parcel, such as a handheld device for accepting and recording a recipient's name and/or signature. The receptacle 10 may also be equipped with a delivery confirmation device such as a unique identifier for use by a delivery or courier service to electronically confirm delivery of a parcel or letter. The unique identifier can be provided on the receptacle 10 by etching, molding, name plate, sticker, LCD, or any other suitable means. This identifier can be scanned by the courier upon delivery to confirm that the parcel was delivered to the recipient's address and placed into the receptacle 10. The scanning of the identifier can be incorporated into the courier's parcel tracking system to alert the recipient that a parcel has been delivered and inserted into receptacle 10. An example of such a tracking system in the shipping industry which alerts the recipient to completed deliveries is UPS My Choice. All of the capabilities of the UPS My Choice program are incorporated by reference herein, and are within the scope of the present invention.

Many other features and concepts are also contemplated for the present invention. The receptacle 10 may be equipped with a method and system for communicating delivery details and the contents of the storage compartment 30. For instance, a WiFi or other wireless communication (e.g. cellular phone communication) enabled camera may be utilized to provide images of the contents of the storage compartment 30 after a delivery has been made. The wireless enabled camera is configured to transmit the images to the owner of the receptacle electronically, such as via the internet or other communication network, an SMS message, an email, or other suitable communication. The camera and transmission of images may be activated by the detection of a delivery to the receptacle, or by the delivery alert sent by the courier as described above.

A spring, hydraulic, gas strut, or the like may be provided which connects the delivery door 38 and/or the drum 50 to the housing 12 and imparts a biasing force which serves to assist in closing and/or opening the delivery door 38. A hinged linkage can be configured such that the spring or other biasing device begins to assist in closing the delivery door 38 only near the limit of travel, so it feels to the user as if the spring or other biasing device takes over the work of closing and keeping the door closed.

Still another feature allows an owner to prevent deliveries to the receptacle 10, such as when the owner is out of town for an extended period of time, or otherwise desires to prevent deliveries for whatever reason. For instance, a pin may be inserted into holes provided in the delivery door 38 to secure the delivery door 38 in the closed position. The pin may be secured by a locking device, such as any of the locking devices described herein. Alternatively, the receptacle 10 may be provided with any suitable locking device for locking the delivery door 38 in the closed position, such as a locking latch, etc.

The receptacle 10 may also be provided with a slot in the front wall 22 and/or in the access door 36 to allow delivery of a letter, priority document envelope, or similar article, without opening the delivery door 38. This can be useful because it allows delivery of smaller, thin items, even if the storage compartment is full of large parcels. A separate storage compartment may even be provided adjacent the slot for storing deliveries inserted through the slot.

The receptacle 10 may also have an electrical connection to a home alarm system, so that the receptacle can be monitored for theft or tampering. One or more alarm sensors may be placed in and around the receptacle 10, and connected to the home alarm system.

Weather stripping may be provided around the delivery door 38, access door 36, and/or around the seams of the housing 12 to inhibit water from entering the housing.

Furthermore, the receptacle 10 may include one or more additional accessories and options to provide additional functionality and/or enhance the receptacle 10. Any one or more of the following accessories and option may be attached to, affixed on, or connected to the housing 12 of the receptacle:

1) Hooks, such as coat hooks for visitors;
2) Umbrella holder;
3) Separate additional locked or unlocked storage compartment for personal use;
4) Thermometer or other weather measuring devices;
5) Decorative items to adorn the receptacle 10, such as a planter, themed magnets, themed toppers, Halloween candy tray;
6) Welcome sign;
7) Address plaque;
8) Message chalkboard, pad or clip;
9) Lighting on the outside and/or walkway lighting, powered by solar, battery or AC power;
10) Lighting on the inside to aid in retrieving contents, powered by solar, battery or AC power;
11) Personalized Monogram;
12) Pet water and food dispenser attached to the bottom;
13) Hose reel;
14) Shoe scraper;
15) Cat bed, preferably on roof;
16) Bird feeder or bird house, preferably on the roof;
17) Flag pole attachment;
18) Ash tray for disposing of cigarettes before entering home;
19) Magazine or newspaper holder;
20) Hide-a-key
21) LCD screen or other electronic display connected to broadcast and/or CCTV signal, and configured to show programming and/or advertising to passersby, similar to the system used in elevators, at gas station pumps, etc. This feature would be most useful in a secure and populated environment, such as a hotel, lobby, post office, college dorm, etc.

Although particular embodiments have been shown and described, it is to be understood that the above description is not intended to limit the scope of these embodiments. While embodiments and variations of the many aspects of the invention have been disclosed and described herein, such disclosure is provided for purposes of explanation and illustration only. Thus, various changes and modifications may be made without departing from the scope of the claims. For example, not all of the components described in the embodiments are necessary, and the invention may include any suitable combinations of the described components, and the general shapes and relative sizes of the components of the invention may be modified. Accordingly, embodiments are intended to exemplify alternatives, modifications, and equivalents that may fall within the scope of the claims. The invention, therefore, should not be limited, except to the following claims, and their equivalents.

What is claimed is:

1. A receptacle for receiving and securing an object, comprising:

a housing including a housing cover having an input opening;

a drum rotatably coupled to the housing, the drum disposed within the housing cover, the drum having a drum chamber for receiving an object placed into the drum and a drum access opening through which an object can be placed into the drum chamber, the drum rotatable between a first position in which the drum access opening is accessible through the input opening and a second position in which the drum access opening is aligned with a secure drop area disposed at least one of below or behind the drum thereby allowing an object in the drum chamber to exit out of the drum chamber and into the secure drop area;

a delivery door rotatably coupled to the housing, the delivery door rotatable between a closed position in which the delivery door blocks the input opening and an open position in which the delivery door allows access through the input opening to place an object into the drum chamber;

a linking mechanism mechanically coupling the drum to the delivery door, the linking mechanism configured such that rotation of the delivery door in a first rotational direction causes the drum to rotate in an opposite rotational direction to the first rotation direction.

2. The delivery receptacle of claim 1, wherein the linking mechanism comprises a first gear fixed to the drum and a second gear fixed to the delivery door, the first gear mating with the second gear such that rotation of the first gear in the first rotational direction causes the second gear to rotate in the opposite rotational direction.

3. The delivery receptacle of claim 2, wherein the gear ratio of the first gear to the second gear is about 1:1.

4. The delivery receptacle of claim 1, wherein the delivery door comprises an extension flap extending from a bottom portion of the delivery door downwardly and inwardly toward the drum when the delivery door is in the open position.

5. The delivery receptacle of claim 4, wherein the drum comprises a drum floor and a drum roof, and the delivery door comprises an extension flap extending from a bottom portion of the delivery door downwardly and inwardly toward the drum when the delivery door is in the open position, and wherein relative movement and position of the drum roof, drum floor and extension flap work together to restrict access and prevent a line of sight through the input opening to the secure drop area substantially throughout the rotational movement of the delivery door and drum.

6. The delivery receptacle of claim 1, wherein the drum comprises a drum floor, a drum roof, and two opposing drum side panels and a drum rear panel which form the drum chamber, the drum floor, drum roof and drum side panels tapering outwardly slightly from the rear panel to the drum access opening.

7. The delivery receptacle of claim 1, wherein the delivery door is coupled to the housing by a hinge along the bottom of the delivery door, and the drum is coupled to the housing by a one or more brackets connected to a roof of the housing and a rotating shaft and bushing assembly for coupling each bracket to the drum.

8. The delivery receptacle of claim 1 wherein the housing further comprises an object removal opening in the housing cover which provides access to the secure drop area to remove an object from the secure drop area and an access door covering the object removal opening.

9. The delivery receptacle of claim 8, wherein the access door has a locking device for selectably locking and unlocking the access door.

10. The delivery receptacle of claim 1, further comprising a delivery detector which is configured to detect when a delivery has entered the secure drop area and to provide a signal to indicate that a delivery has entered the secure drop area.

11. The delivery receptacle of claim 10, wherein the signal is one of an electronic message sent through the internet, an SMS message, or an email.

12. The delivery receptacle of claim 1, further comprising a secure drop area level detector which is configured to detect when secure drop area is full and an interlock which automatically locks the delivery door when the secure drop area level detector detects that the secure drop area is full.

13. A receptacle for receiving and securing an object, comprising:

a housing including a housing cover having an input opening;

a drum rotatably coupled to the housing, the drum disposed within the housing cover, the drum having a drum floor, a drum roof and a drum rear panel forming a drum chamber for receiving an object placed into the drum, the drum further comprising a drum access opening through which an object can be placed into the drum chamber, the drum rotatable between a loading position in which the drum access opening is accessible through the input opening and an unloading position in which the drum access opening is aligned with a secure drop area disposed at least one of below or behind the drum thereby allowing an object in the drum chamber to exit the drum chamber and enter the secure drop area, the drum roof having a drum roof lip which is adjacent a top of the input opening when the drum is in the loading position and a drum floor lip which is adjacent a bottom of the input opening when the drum is in the loading position;

a delivery door rotatably coupled to the housing, the delivery door rotatable between an open position in which the delivery door allows access through the input opening to place an object into the drum chamber when the drum is in the loading position, and a closed position in which the delivery door blocks the input opening when the drum is in the unloading position;

a linking mechanism mechanically coupling the drum to the delivery door, the linking mechanism configured such that rotation of the delivery door in a first rotational direction between the open position and the closed position causes the drum to rotate in an opposite rotational direction to the first rotational direction between the loading position and the unloading position.

14. The delivery receptacle of claim 13, wherein the linking mechanism comprises a first gear fixed to the drum and a second gear fixed to the delivery door, the first gear mating with the second gear such that rotation of the first gear in the first rotational direction causes the second gear to rotate in the opposite rotational direction.

15. The delivery receptacle of claim 14, wherein the gear ratio of the first gear to the second gear is about 1:1.

16. The delivery receptacle of claim 13, wherein the delivery door comprises an extension flap extending from a bottom portion of the delivery door downwardly and inwardly toward the drum when the delivery door is in the open position.

17. The delivery receptacle of claim 16, wherein the relative movement and position of the drum roof lip, drum floor lip and extension flap work together to restrict access and prevent a line of sight through the input opening to the secure drop area substantially throughout the rotational movement of the delivery door and drum.

18. The delivery receptacle of claim 13, wherein the drum further comprises two opposing drum side panels which form the drum chamber, and wherein the drum floor, drum roof and drum side panels taper outwardly slightly from the rear panel to the drum access opening.

19. The delivery receptacle of claim 13, wherein the delivery door is coupled to the housing by a hinge along the bottom of the delivery door, and the drum is coupled to the housing by a one or more brackets connected to a roof of the housing and a rotating shaft and bushing assembly for coupling each bracket to the drum.

20. The delivery receptacle of claim 13, wherein the housing further comprises an object removal opening in the housing cover which provides access to the secure drop area to remove an object from the secure drop area and an access door covering an object removal opening.

21. The delivery receptacle of claim 20, wherein the access door has a locking device for selectably locking and unlocking the access door.

22. The delivery receptacle of claim 13, further comprising a delivery detector which is configured to detect when a delivery has entered the secure drop area and to provide a signal to indicate that a delivery has entered the secure drop area.

23. The delivery receptacle of claim 22, wherein the signal is one of an electronic message sent through the internet, an SMS message, or an email.

24. The delivery receptacle of claim 13, further comprising a secure drop area level detector delivery detector which is configured to detect when secure drop area is full and an interlock which automatically locks the delivery door when the secure drop area level detector detects that the secure drop area is full.

* * * * *